US007231894B2

(12) United States Patent
Driver

(10) Patent No.: US 7,231,894 B2
(45) Date of Patent: Jun. 19, 2007

(54) ROTARY POSITIVE DISPLACEMENT MACHINE

(75) Inventor: Ronald William Driver, Chatburn (GB)

(73) Assignee: E.A. Technical Services Limited, Chatburn, Lancashire (GB)

( * ) Notice: Subject to any disclaimer, the term of this patent is extended or adjusted under 35 U.S.C. 154(b) by 121 days.

(21) Appl. No.: 10/501,148

(22) PCT Filed: Jan. 17, 2003

(86) PCT No.: PCT/GB03/00194

§ 371 (c)(1),
(2), (4) Date: Sep. 2, 2004

(87) PCT Pub. No.: WO03/062604

PCT Pub. Date: Jul. 31, 2003

(65) Prior Publication Data

US 2005/0000214 A1 Jan. 6, 2005

(30) Foreign Application Priority Data

| | | |
|---|---|---|
| Jan. 17, 2002 | (GB) | 0200991.8 |
| May 21, 2002 | (GB) | 0211603.6 |
| Jul. 11, 2002 | (GB) | 0216084.4 |
| Oct. 2, 2002 | (GB) | 0222776.7 |
| Nov. 7, 2002 | (GB) | 0225939.8 |

(51) Int. Cl.

| | |
|---|---|
| ***F02B 57/00*** | (2006.01) |
| ***F02B 53/04*** | (2006.01) |
| ***F04B 25/00*** | (2006.01) |
| ***F04B 3/00*** | (2006.01) |
| ***F04B 5/00*** | (2006.01) |
| *F01B 13/04* | (2006.01) |

(52) U.S. Cl. ..... 123/43 R; 123/235; 418/247; 418/248; 418/62

(58) Field of Classification Search ..... 418/247–248, 418/267–268, 62, 153; 123/43 R, 235; 60/397, 60/679

See application file for complete search history.

(56) References Cited

U.S. PATENT DOCUMENTS

| | | | | | |
|---|---|---|---|---|---|
| 663,184 | A | * | 12/1900 | Morris | 418/247 |
| 922,189 | A | * | 5/1909 | Pratt | 418/247 |
| 1,079,561 | A | * | 11/1913 | Kinney | 418/62 |
| 1,584,824 | A | * | 5/1926 | Teesdale | 418/62 |
| 3,081,707 | A | * | 3/1963 | Marshall | 418/248 |
| 3,303,790 | A | | 2/1967 | McCray | |
| 3,895,609 | A | | 7/1975 | Armstrong | |
| 3,896,772 | A | | 7/1975 | Lyle | |

(Continued)

FOREIGN PATENT DOCUMENTS

| | | | |
|---|---|---|---|
| BE | 773 897 | * | 1/1972 |

(Continued)

*Primary Examiner*—Thai-Ba Trieu
(74) *Attorney, Agent, or Firm*—Baker Hostetler LLP

(57) ABSTRACT

A rotary displacement machine includes a casing having a circular cylindrical internal surface and a rotor disposed in the chamber mounted to orbit about a chamber axis, with the rotor having a circular cylindrical external surface. A vane member is mounted on the casing and pivotable about a pivot axis parallel to the chamber axis. The vane member has a passage way communicating between the exterior of the casing and the operating chamber. A linkage connects the vane member to the rotor so as to keep a tip face of the vane member in sealing contact with an external surface of the rotor.

32 Claims, 25 Drawing Sheets

U.S. PATENT DOCUMENTS

| | | | | |
|---|---|---|---|---|
| 4,149,833 | A * | 4/1979 | Baudin | 123/43 R |
| 4,831,827 | A | 5/1989 | Driver | |
| 6,226,986 | B1 | 5/2001 | Driver et al. | |

FOREIGN PATENT DOCUMENTS

| | | | |
|---|---|---|---|
| CH | 334058 | * | 11/1958 |
| CH | 657665 A | * | 9/1986 |
| DE | 77480 | * | 11/1891 |
| DE | 488069 | * | 12/1929 |
| DE | 41 15 104 A1 | * | 5/1991 |
| EP | 1 593 849 A1 | * | 11/2005 |
| FR | 510945 A | * | 12/1920 |
| GB | 1085542 | * | 10/1967 |
| GB | 1289473 A | * | 9/1972 |
| WO | WO 9209800 A1 | * | 6/1992 |
| WO | WO 9400680 A1 | * | 1/1994 |
| WO | WO0120167 A | * | 3/2001 |

* cited by examiner

ROTARY POSITIVE DISPLACEMENT MACHINE

FIELD OF THE INVENTION

This invention relates in general to rotary positive displacement machines.

BACKGROUND OF THE INVENTION

More particularly, the invention relates to a machine comprising a casing, an orbiting rotor, and a vane member.

The present invention provides a rotary positive displacement machine comprising:

a casing having a circular cylindrical internal surface delimiting an operating chamber, a rotor in the operating chamber, the rotor being mounted so as to orbit about a chamber axis which is the axis of the said internal surface, the rotor having a circular cylindrical external surface, the chamber axis passing through the rotor, a generatrix of the external surface being adjacent to the said internal surface, and a diametrically opposite generatrix being spaced from the said internal surface;

a vane member mounted on the casing and being pivotable about a pivot axis parallel to the chamber axis, the vane member being accommodated in a fluid inlet/outlet aperture in the casing, the vane member having a passageway communicating between the exterior of the casing and the operating chamber, the vane member having an arcuate face which is coaxial with the said pivot axis and which has a length substantially equal to that of the rotor, the vane member having end faces extending from the respective lateral ends of the arcuate face towards the pivot axis, and the vane member having a tip face adjacent the rotor, the said faces being sealing faces with respect to corresponding surfaces of the casing aperture and the rotor; and a linkage which connects the vane member to the rotor so as to keep the tip face of the vane member in sealing contact with the external surface of the rotor, the linkage being connected to the vane member by an articulation having an articulation axis such that a plane containing the articulation axis and the axis of the said external surface passes through the region of sealing contact.

SUMMARY OF THE INVENTION

The machine may be used as a supercharger for an internal combustion engine, as a turbine for recovering energy from inlet manifold depression, or as a turbine for recovery energy from the exhaust or may be used as a compressor or an expander in a heat pump, for example.

BRIEF DESCRIPTION OF THE DRAWINGS

The invention will be described, by way of example only, with reference to the accompanying drawings, in which.

DETAILED DESCRIPTION OF THE INVENTION

Figure 1:
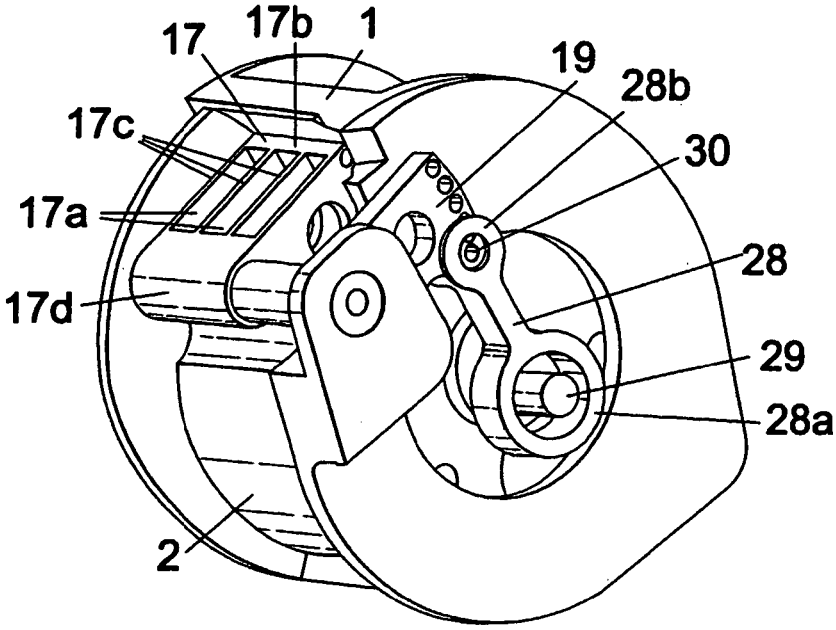
FIGS. 1 to 3 show various perspective views of one embodiment of a machine in accordance with the invention.
Figure 2:
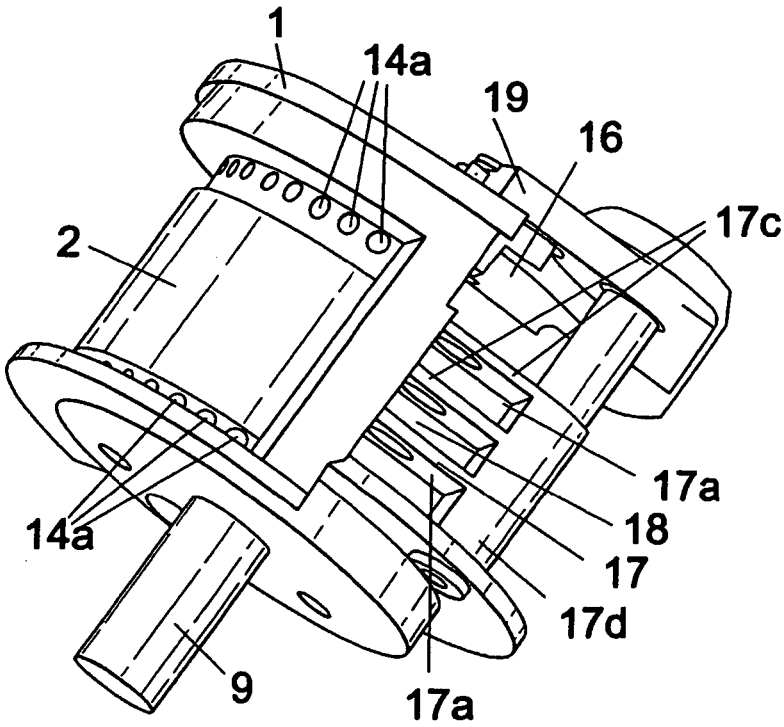
Figure 3:
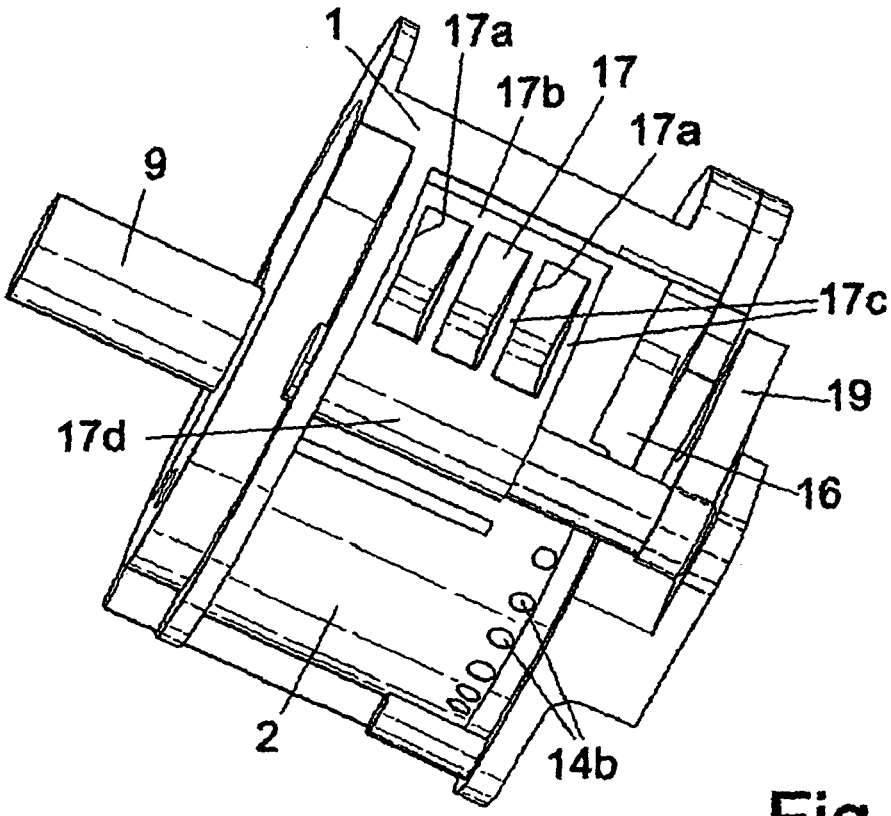

Spark ignition engines conventionally control their power output by controlling the amount of air that passes through the intake system. A throttle regulates the airflow: at maximum power the throttle is fully open and at idle the throttle is substantially closed. When the throttle is partly closed the engine's intake manifold is below ambient air pressure and the engine has to do work to draw in the air.

The maximum temperature at the end of the compression stroke in a spark ignition engine is limited by the need for satisfactory combustion and combustion timing, the maximum compression temperature can easily be reached with conventional compression ratios. When an engine is supercharged the efficiency of compression by the supercharger is generally less than the engine's compression efficiency and this results in a higher temperature for a given pressure than a naturally aspirated engine on its own. A supercharged engine normally has the supercharged air cooled in a heat exchanger and the compression temperature limit generally necessitates a lowering of the engine's compression ratio. With a supercharged and reduced compression ratio engine, the pressure at the end of the power stroke is higher than in a naturally aspirated engine; to reduce the waste of this energy the exhaust gases are generally passed through a turbine.

Private automotive vehicles spend most of their time at part power and in the case of spark ignition engines this means at part throttle, with its attendant throttling losses. Improvements in engine efficiency could be made if the throttling losses could be eliminated. There are two ways of eliminating throttling losses: one is to recover the losses by putting a turbine in the intake and the other is to eliminate the throttling process by not having any part of the cycle at pressures below ambient. To achieve the latter and have an acceptable range of power, an engine must:

- have a cylinder full of air at ambient pressure at idle;
- have a reduced compression ratio at idle;
- gradually increase the amount of pressure ratio until maximum power is reached.

It will be appreciated that since conventional engines have their cylinders full of ambient pressure air at full power, to have an engine with a cylinder fill of ambient air at low or idle speed, and yet only give idle power, the engine must be appreciably smaller for the same low power requirement. Or alternatively, the air flow must be regulated.

Regulating the flow and degree of supercharge of air entering an engine has been difficult and inefficient. It has been difficult because superchargers could not control the degree of supercharge accurately enough over the required range and inefficient because compression efficiency and airflow control was poor and wasteful.

In spark ignition engines combustion will only take place within very narrow limits of fuel to air ratio. Gasoline Direct Injection (GDI) is used to provide specific regions of the engine's cylinder with a combustible mixture, whilst allowing other regions to have an increased proportion of air, thus reducing the amount of throttling required. Another method of eliminating throttling losses is to vary the valve timing and valve lift (VVT), this allows some of the air that entered the cylinder to be pushed out by the piston before the valves close. Both GDI and particularly VVT increase the cost and complexity of engines.

Over the past few years, hybrid engines have been proposed that were a combination of an electric motor and a relatively small engine running at near maximum power whenever it was used. More recently there has been a move to a higher voltage electrical system, this permits the engine to stop when the vehicle stops; then the vehicle initially moves off using the electric motor.

The present inventor proposes the use a combination of supercharger (which may function as a throttle loss recovery turbine), internal combustion engine, and exhaust turbine. The exhaust turbine may drive a compressor or electrical generator or both. The enabling technology to permit efficient use of this combination of components is the use of a rotary positive displacement machine incorporating the features described below. This type of machine allows the internal combustion engine's airflow to be controlled. It takes a full charge of air each revolution and evacuates air not required by pushing it out through a metering orifice or orifices and allows the remainder to be discharged to the engine.

If sufficient air is evacuated and the volume remaining is less than is required to fill the engine's cylinder with ambient pressure air, the cylinder pressure will fall to below ambient and with it the pressure on the outlet side of the supercharger. The difference between ambient air pressure and the supercharger outlet will drive the supercharger, thus recovering the energy used by the engine to produce the partial vacuum in the cylinder (the throttling losses). In this manner the supercharger can supply air from below ambient pressure to maximum supercharge pressure. This type of supercharger has compression efficiency comparable with the efficiency of the compression within an engine and an ability to accurately control airflow. This combination of components eliminates the need for expensive GDI and VVT systems and with the exception of the supercharger, needs only conventional components and fuel systems although using GDI may increase the range of power. Adding a heat exchanger to the combination enables an engine of about 1-litre to have the same power output as a 2-litre engine but with a considerably reduced weight and fuel consumption.

With the swept volume of the internal combustion engine known, a supercharger of this type can be designed for a particular supercharger maximum pressure and with the inlet control the supercharger output pressure can be varied from below ambient to maximum pressure. Under these conditions the supercharger's outlet orifice or orifices position and size are constant and no variation is necessary.

The rotary positive displacement machine illustrated in FIGS. 1 to 6 can function as a supercharger and as a throttle loss recovery turbine and has a stator or casing 1 with a peripheral wall 2 having a circular cylindrical internal surface 3. A rotor 4 arranged in the stator 1 is provided at each end with a shutter in the form of a flange or disc 6, having a circular cylindrical periphery 7 with only a small clearance between itself and the internal surface 3. The discs 6 together with the portion of the internal surface 3 extending between them delimit a circular cylindrical operating chamber in which the rotor 4 can orbit about the axis of the internal surface 3. The rotor 4 is provided with a drive shaft 9. The rotor 4 has a circular cylindrical external surface 11 with an axis which is eccentric with respect to the axis of the internal surface 3 of the stator 1. The latter axis passes through the rotor 4. One generatrix 13 of the external surface 11 has only a small clearance. The diametrically opposite generatrix is spaced from the internal surface 3. A machine of this type is described in more detail in WO 02/04787.

An important feature of the machine illustrated in FIGS. 1 to 6 is that a vane member 17 is accommodated in an aperture 18 in the casing 1 which functions as a fluid inlet/outlet aperture. The vane member 17 has passageways 17*a* communicating between the exterior of the casing and the operating chamber.

Control of either inlet or outlet is simply achieved by exposing more or less orifice area Having apertures in the rotor disc 6, casing 1, and an outer ring 16 most easily does this. By sliding the outer ring 16 over the interposed casing 1, more or fewer casing apertures are exposed; when the rotor disc apertures are adjacent the exposed casing apertures, air can pass through if the position of the slide allows it. By this method pressure and mass flow can be controlled.

With the impending widespread introduction of higher voltage electrical systems in vehicles, auxiliary equipment will increasingly be driven by electric motors rather than directly by the internal combustion engine. Using an electric motor and varying the machine speed relative to the engine speed could additionally control the airflow.

Similar machines can be used for compressing other fluids, for instance refrigerants. Machines that compress refrigerants are normally referred to as heat pumps. Heat pumps generally run at constant speed and stopping and starting the machine several times over a period of time normally controls the average heat output. By using a sliding ring to vary the exposed orifice size and position in heat pumps it is possible to vary the pressure and heat output of them. By adding a variable speed motor a full range of heating and cooling outputs can be achieved without "stopping and starting" the machine. A further consequence of the control system using the sliding ring 16 described here is the ability to control the inlet conditions to the expander by controlling the compressor outlet and/or inlet conditions. Thus not only can the parameters of speed, pressure and heat output from the compressor be controlled; the expansion inlet conditions for the turbine expander can be controlled indirectly by controlling one or a number of compressor outlet parameters.

It will be understood that a sliding ring at the expander inlet could also be used for expander inlet control. The benefits though, of controlling the expander inlet may be outweighed by the loss in fluid properties caused by the sudden expansion or "flashing" of the refrigerant. There may therefore be substantial benefits of indirectly controlling the flow by controlling the compressor flow, and using a constant expansion orifice and a wide rotor side disc 6 to create a gradually increasing orifice area for a smooth expansion.

In the present rotary or rolling piston machine, when functioning as a compressor, the volume of fluid trapped between the rotor 4 and the vane member 17 can be varied from a full to minimum charge by allowing the charge to pass out again through evacuation orifices 14*b* before compression begins. In the case of a supercharger the full charge would be the amount required to fill the internal combustion engine's cylinder with air at the design pressure and the minimum would be the volume required to fill the cylinder at either ambient pressure or, if a partial vacuum was required, to the volume required for that pressure.

By having the casing 1 interposed between the slide 16 and the rotor 4, fluid can pass into or out of the machine when orifices in all three components are aligned.

To maintain high thermodynamic efficiency, manufacturing clearances need to be of the order of 0.02 mm, which leaves very little allowable distortion due to centrifugal, inertial, or fluid pressure forces. The pressure forces are approximately 2 bar for superchargers, 3 bar for fuel cell compressors, and ranging from 15 to 90 bar for heat pumps.

In automotive applications the minimum maximum speed is likely to be 6000 revolutions per minute and for heat pumps 3600 revolutions per minute. The speed and size of automotive applications gives rise to inertia loads and heat pumps have high pressure loads. Both these loads cause deflection of conventional vane shapes and the increased clearances to allow for the deflection causes a loss of efficiency by allowing fluid to leak away. In the present case the vane member 17 is shaped to give maximum resistance to deflections due to inertia and pressure. The shape and positioning of the vane relative to the casing and actuating mechanism to minimise the loads means there would be a restriction on the area for fluid flow under the vane and into the machine. If the circumferential length of the inlet orifice was increased to overcome the inlet flow restriction the machine's capacity would be reduced. Allowing the fluid to enter through the vane member 17 eliminates any inlet flow restriction. The shape of the vane member 17 therefore provides maximum resistance to inertia and pressure loads and minimum resistance to inlet fluid flow. The vane member 17 has an arcuate end wall 17*b*, transverse walls 17*c* extending from the end wall 17*b* to a pivotally mounted end-piece 17*d*, and a tip face 17*g* which is a sealing surface with respect to the rotor 4.

When the machine is used as a supercharger the volume flow is fixed by the physical size of the internal combustion engine's cylinders but the mass flow is determined by the engine's power requirement. Varying the supercharger outlet pressure can vary the mass flow. In the present case the supercharger is initially filled with ambient air and as the rotor 4 rotates towards the arcuate surface 17*e* of the vane member 17 the air is compressed. The mass of air to be compressed can be varied (and therefore its pressure can be varied) by allowing some of the air to be evacuated before compression begins. This is achieved by providing passages 23 in the side discs 6 and evacuation orifices 14*b* in the casing 1. When the slide 16 exposes the holes 14*b* in the casing 1 the air can flow out of the machine through the passages 23 and casing holes 14*b*. The slight air pressure rise as the rotor 4 advances towards the vane member 17 provides the pressure drop needed to evacuate the air.

It is unlikely that the outlet volume of air will need to be varied, therefore there will be no need for a slide on the outlet and the outlet orifices 14*a* can be fixed and the compressed air discharged through them. However, should there be a need to vary the outlet volume orifice area a slide can be provided in a similar manner to that provided for evacuation as described earlier.

The side discs 6 are relatively long in the axial direction and leakage is governed by pressure drop, radial clearance, surface roughness, axial length and fluid properties. Leakage in this case is relatively insensitive to changes in axial length and to radial clearance changes caused by changes in machine temperature and there is no end load caused by pressure. With the radial exit design the rotor transfer orifice volume increases as the disc width increases and with it the transfer losses.

By making the side discs 6 L-shaped in radial section, in a machine with axial passage 23' in the disc 6 (FIGS. 7 and 8), and bringing the casing 1 round the contour of the "L", the leakage over the discs can be reduced. The side disc running clearance and the working volume are in direct communication with each other via the disc passages; thus two leakage paths are available for the fluid. By interposing the casing between a slide and the rotor and fitting a face slide control, the flow and pressure can be controlled in a similar manner to that described above.

As with all machines of this type their efficiency is crucially dependent on the amount of leakage; contact seals will produce unacceptably high friction losses apart from those on very large machines where the percentage of friction can be brought within acceptable bounds. With axial entry or exit the change in axial clearance due to thermal effects will affect machine efficiency and this will impose a limit on the machine's length. This together with the difficulty of accurately machining several parts and assembling them and a bearing together, and the required total clearance gap of less than 0.02 mm, makes a satisfactory design difficult. With radial exit and entry the manufacturing of two round components is easily controlled. A manufacturing easement for concentrically fitted parts could be to put a lining or abradable coating on one component, for instance a polymer material, which would allow wear on the first rotation, then the maximum clearance obtained is that caused by thermal expansion.

With an axial entry and exit and face slide control there is a need to hold the slide in position, rotate it, and to fully react any tendency for pressure to lift it off the face. In the case of a radial slide, the diameter of a slide closely fitted to the diameter of a casing automatically reacts against any pressure loads and therefore only requires to be rotated.

In the present machine air or fluid exits the machine when orifices are in alignment as the machine rotates. There are no conventional valves and manufacturing costs are reduced and reliability increased. There are penalties for this simplistic design though. Pushing the fluid out of the machine produces a pressure drop across the orifice, and the extra pressure is a parasitic loss. By increasing the orifice area this loss is reduced but the loss from transferring fluid from high to low pressure increases. In the case of radial exit with little pressure loss the loss from transferred fluid is 10%. A compromise between pressure and transfer losses results in an overall loss of 5%. With axial exit the transfer loss is small but the leakage is high, adding an axial extension to the rim of the disc reduces the leakage but accurate axial clearance control is required to produce an overall loss of 5%. The added disadvantage of the increased cost of a slide control makes this design unattractive. However, in the case of outlet to the internal combustion engine when there is no requirement for slide control there may be some vehicle installation requirements that make axial exit desirable. Therefore a combination of axial and radial exit and evacuation may be desirable under some circumstances.

Figure 4:
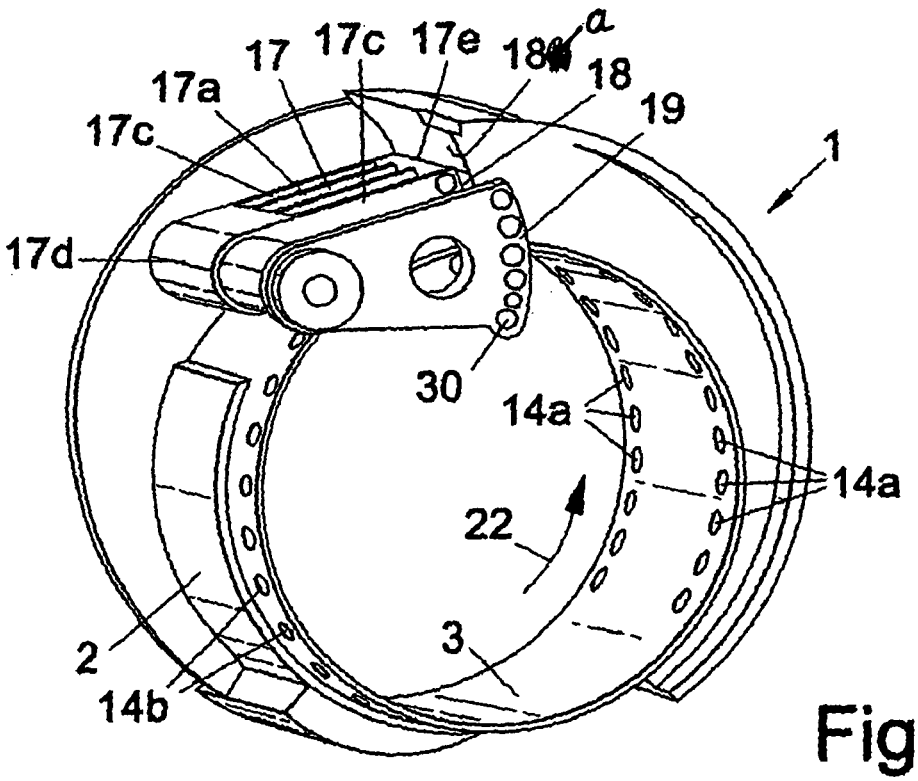
FIG. 4 is a cut away perspective view showing the casing and a vane member.
Figure 6:
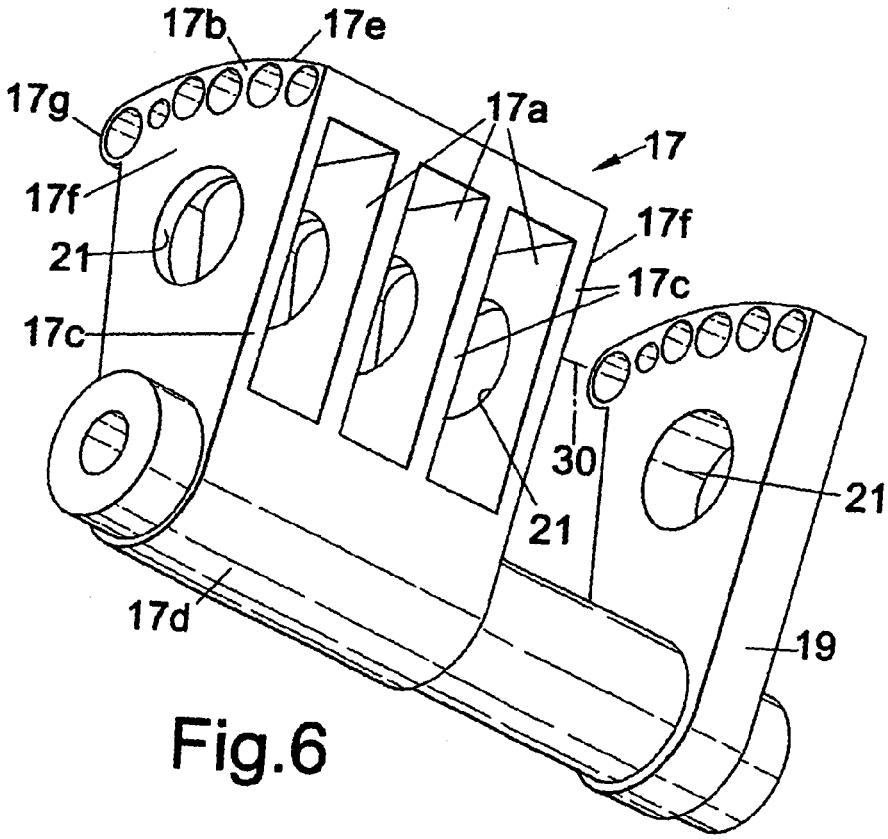
FIG. 6 is an enlarged perspective view of the vane member.

Referring to FIGS. 4 and 6 in particular, the arcuate end face 17*e* of the vane member 17 is concentric with the pivot axis and is a sealing face with a static conforming face 18*a* of the casing 1. The flat sides 17*f* of the vane are also sealing faces with the casing. A lever arm 19 may be integral with or attached to the vane member 17. Optional weight reduction holes 21 are also shown.

FIG. 4 shows the relationship of exit holes 14*a* and evacuation holes 14*b* in the casing to the vane member 17 and to the rotor direction of rotation (arrow 22). The rotor is not shown. The fluid inlet aperture 18 typically extends 40° (but optionally up to 70°) from the point at which the end face 17*e* of the vane member intersects the casing inner surface 3 (0°) and the region for evacuation (orifices 14*b*) a further 140°. The exit region (orifices 14*a*) is typically from 240° to 360°. The number of degrees in each region will vary as the machine size varies and is dependent on the optimisation of fluid pressure loss and fluid transfer loss.

Figure 5:
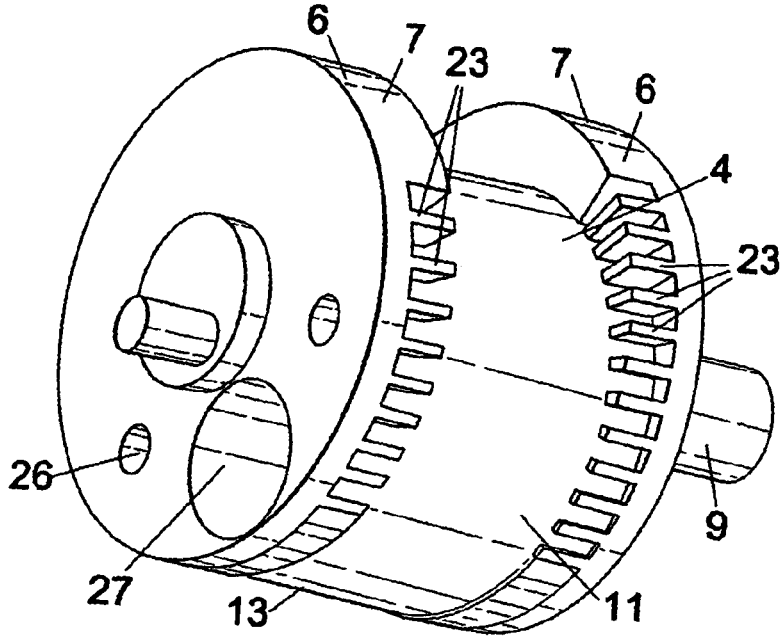
FIG. 5 is a perspective view of the rotor and associated parts.

FIG. 5 shows a rotor 4 with one type of exit and evacuation passage 23 in the side discs 6. To equalize pressure acting on both sides of the rotor 4 and prevent axial end loads a small fluid transfer hole 26 is provided. To minimise the volume of fluid that could be held inside the rotor 4 the large weight-reduction hole 27 and any other weight or material reduction features may be filled with a cheap lightweight material or made hollow.

As shown in FIG. 1, a connecting link 28 has one end 28*a* articulated to an extension 29 of the rotor 4 on an axis coincident with the axis of the external surface 11 and the other end 28*b* articulated to the lever arm 19 on an articulation axis 30 such that a plane containing the articulation axis 30 and the axis of the external surface 11 passes through the region of sealing contact between the tip face 17*g* of the vane member and the external surface 11.

Figure 7:
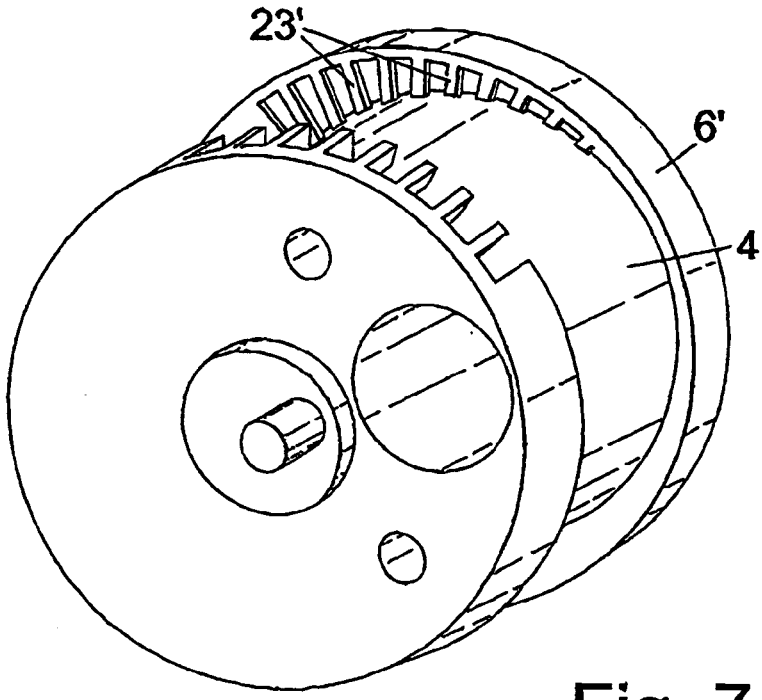
FIGS. 7 and 8 are perspective views of another embodiment of the rotor and associated parts.
Figure 8:
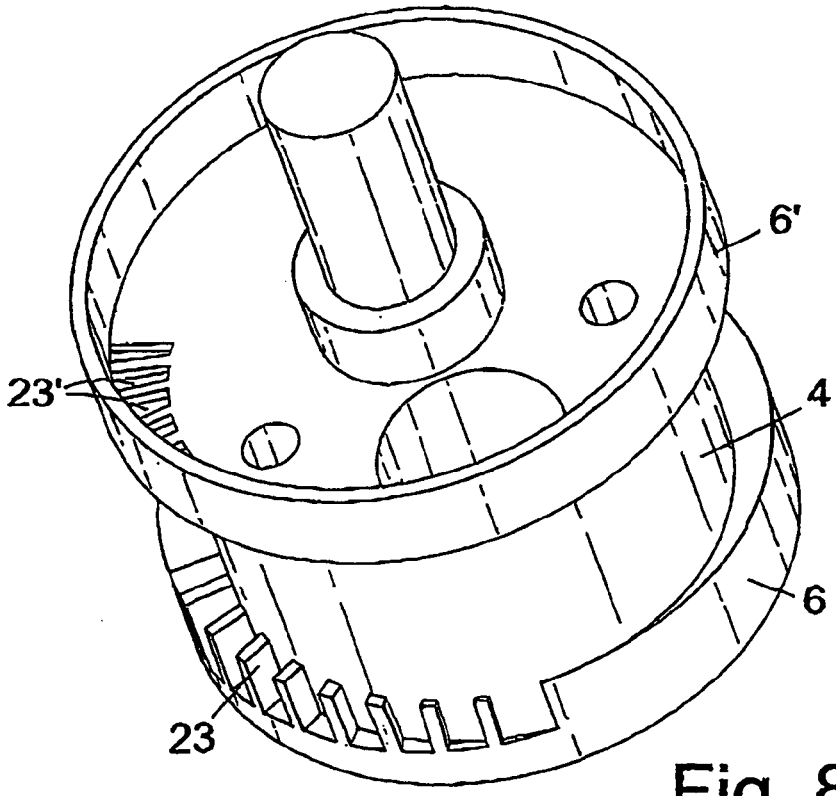

FIGS. 7 and 8 shows two views of the rotor 4 modified to accommodate an axial exit to one side of the rotor through an L-shaped side disc 6'.

Figure 9:
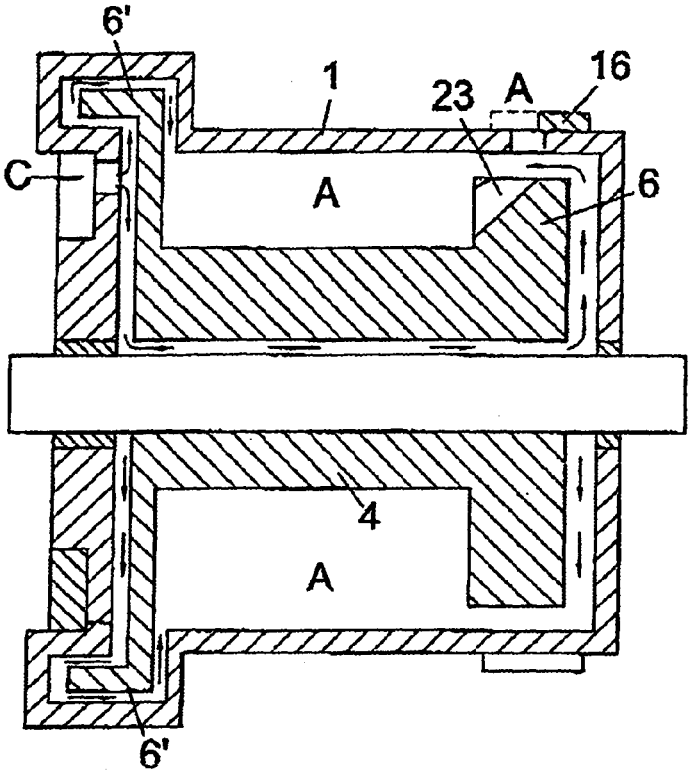
FIGS. 9 to 14 are diagrammatic axial sections through various possible embodiments of a rotary positive displacement machine, showing fluid flow paths.
Figure 10:
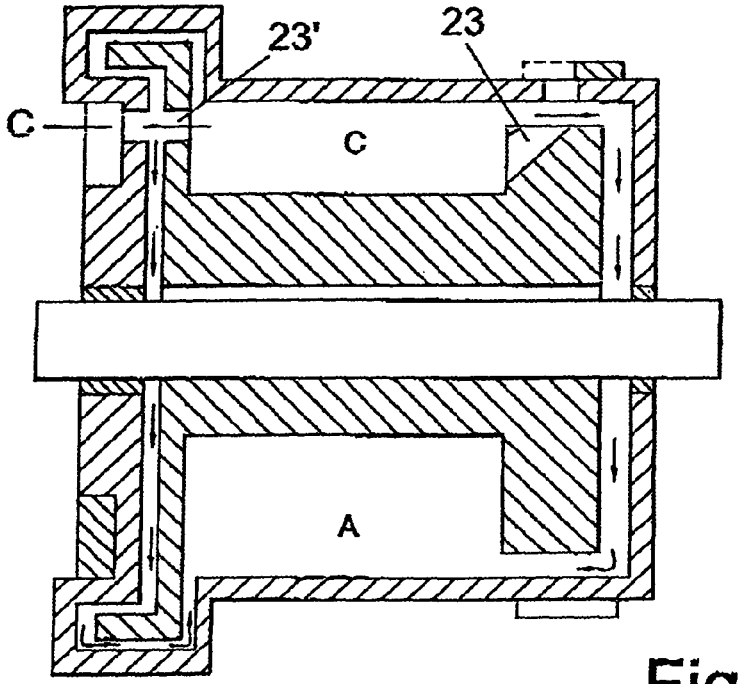
Figure 11:
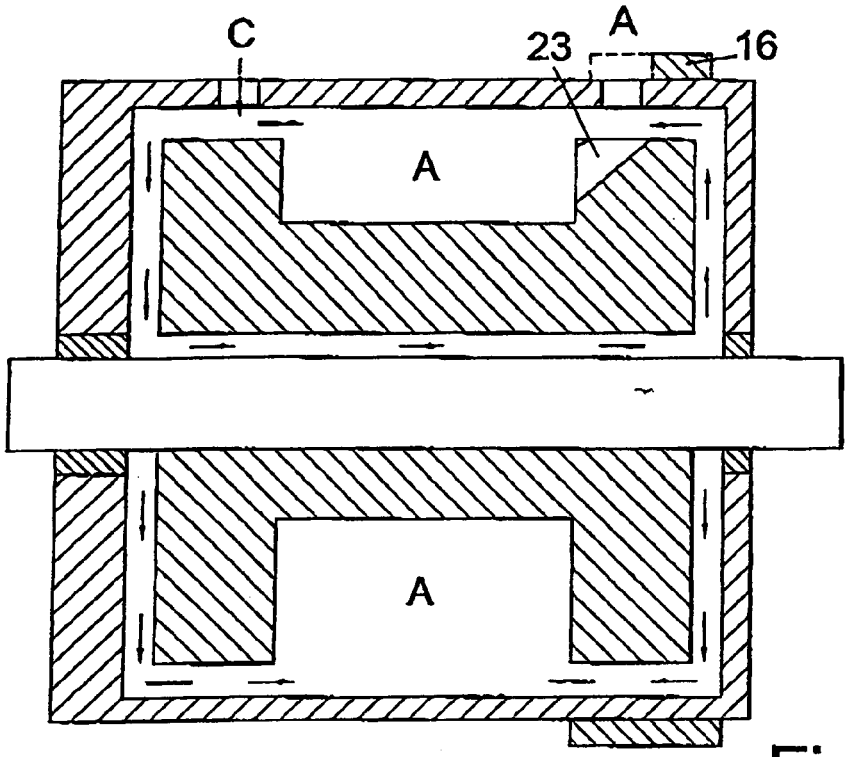
Figure 12:
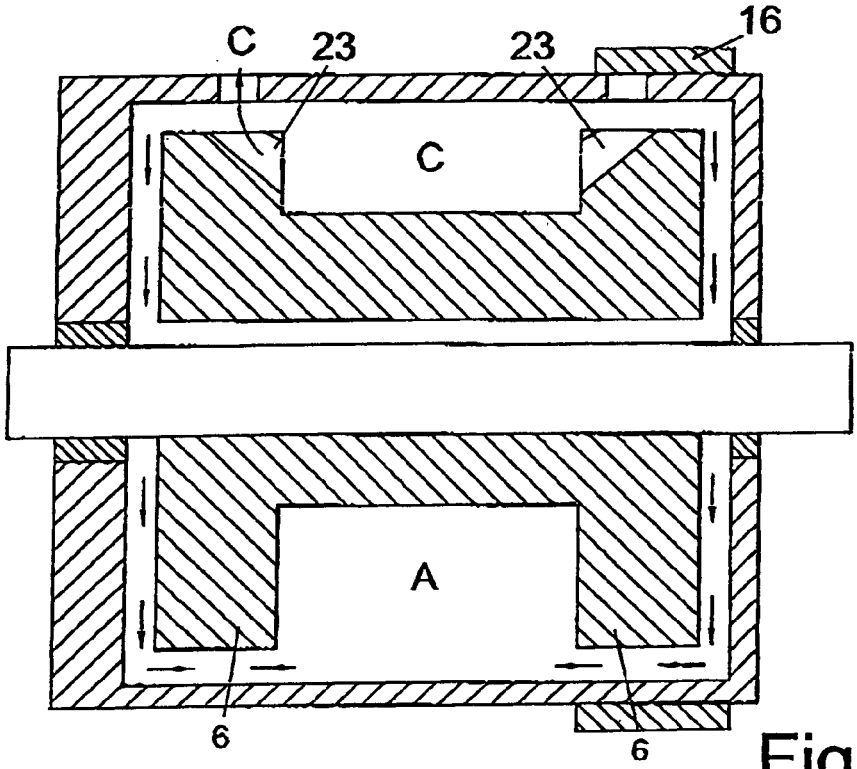
Figure 13:
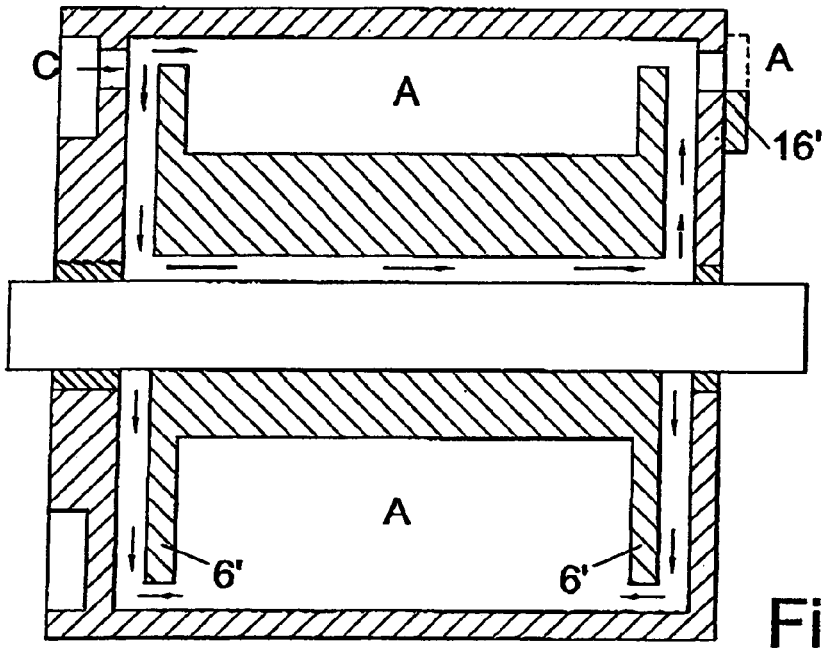
Figure 14:
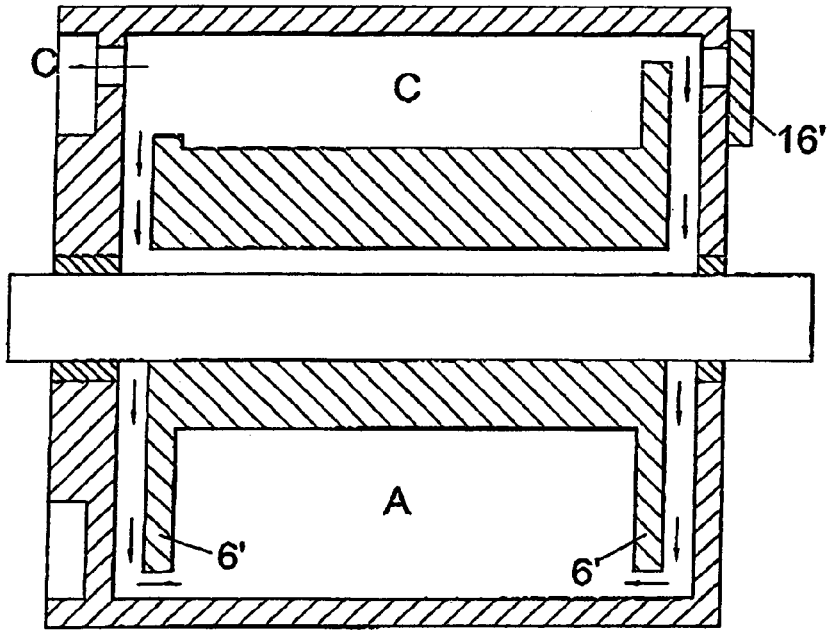

FIGS. 9 to 14 shows the fluid flow and fluid leakage flow path for various configurations. Letter "C" indicates a region where the fluid is in a compressed state and letter "A" where the fluid is at its lowest pressure state. FIGS. 9 and 10 show axial exit and radial evacuation. FIGS. 11 and 12 show radial exit and evacuation. FIGS. 13 and 14 show axial exit and evacuation.

FIG. 9 shows the condition when the charge pressure is higher than the pressure in the machine. Fluid leaking into the machine can flow down the end clearance and directly into the working volume through the axial slots in the side disc 6'. The other entry is over the relatively long diametral clearance of the extended L-shaped disc 6' and over the wide disc 6 opposite via the pressure equalising transfer holes. FIG. 10 is as FIG. 9 but when the machine is discharging. Leakage to the lower pressure region is over the relatively long diametral clearance on both discs. FIGS. 11 and 12 show a machine with a slide ring 16 for evacuation and control of mass flow. In both FIG. 11 and FIG. 12 leakage is over the relatively long diametral clearance on both discs.

FIGS. 13 and 14 also incorporate evacuation control by means of a slide ring 16. It will be appreciated that leakage will be significant over the relatively narrow side discs 6' and lengthening the discs increases the transfer loss. However, this design may be beneficial for controlling air flow in a low pressure blower.

In a supercharger as described above the air outlet to the engine from the supercharger is through holes (or slots) as they became exposed to openings in the casing. With the development of gasoline direct injection (GDI), active combustion, electric drive, regenerative braking and the supercharger as described, internal combustion engines can be further reduced in size without reducing vehicle performance. With this combination an engine of 1.6 litre can be replaced by a 500 cc engine. An engine of 500 cc size fulfilling the function of a 1.6 litre engine will have little or no throttling losses. For an engine with little or no throttling losses the supercharger described above can be increased in efficiency by removing the ability to recover throttling losses. The ducts or transfer passages in the rotor that are used to provide flow from the supercharger to the engine provide a reservoir of air that is transferred back into the supercharger inlet during rotation and causes an efficiency loss of up to 10%. If these transfer passages are only required for the regulation of pressure from ambient upwards, their volume can be reduced and the supercharger efficiency increased. An alternative outlet to the engine may be provided though; this must have less loss than the gain from the reduced transfer volume, otherwise there would be no benefit.

One solution (FIGS. 15 to 18) is to put a valve or valves in the casing 1 between the plane of the side discs 6. The inside surface 3 of the casing 1 is curved, which makes conventional poppet valves difficult to make and expensive. Reed type valves 31 generally introduce some clearance volume (which is a parasitic loss) and some back flow back into the machine (a further parasitic loss). Spring loaded valves require the spring force to be overcome before they open and the air has got to be pressurised by this amount more than the engine requires and this is a further additional loss in efficiency.

In the present case at the time the reed valve 31 is allowing back flow, the rotor 4 is substantially covering the outlet orifice 32 and in close conformity with the inside surface of the casing. This provides time for the closing reed valve inertia to be overcome by the pressure drop of returning air before any substantial flow has occured, closure can be further assisted by a light spring load.

Thus the casing outlet passages to the engine manifold are replaced with a moving valve in the casing of the supercharger which opens as the pressure inside the supercharger increases beyond the pressure inside the engine manifold. The transfer passages 23 in the rotor 4 are reduced in volume to provide sufficient volume and pressure drop for return flow to the supercharger inlet only.

Figure 15:
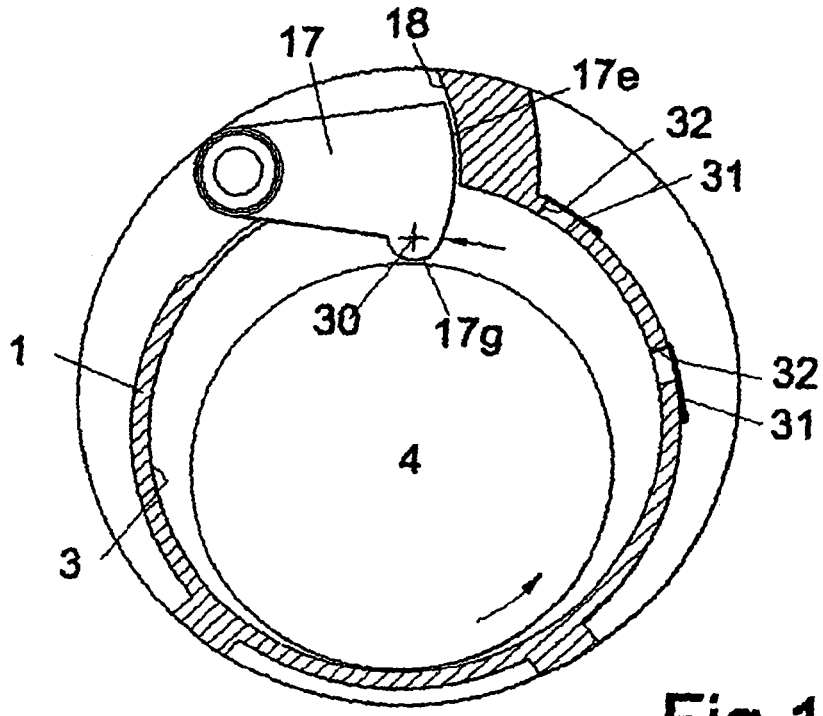
FIG. 15 is a schematic cross-section through another embodiment of a machine in accordance with the invention.
Figure 16:
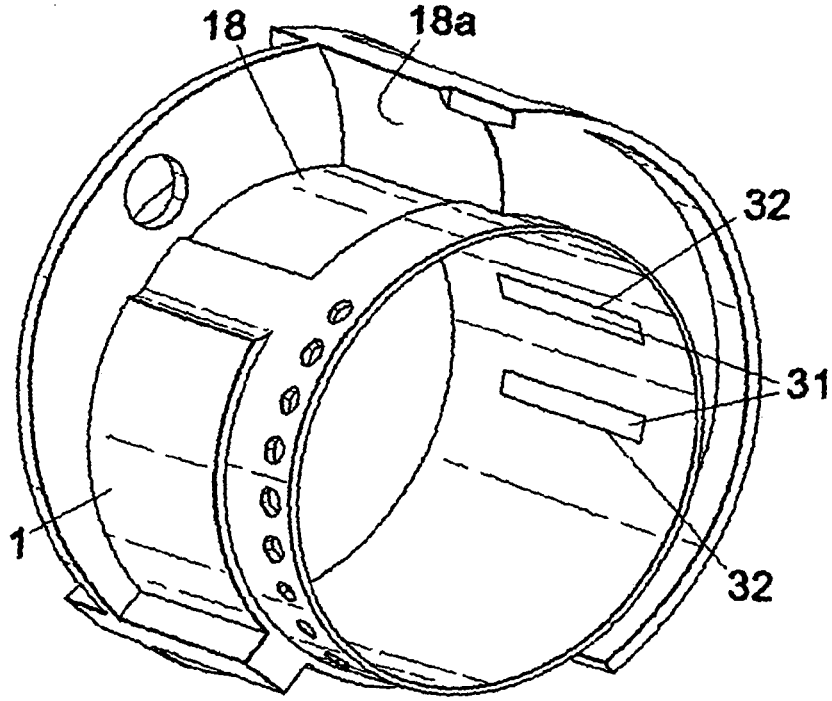
FIG. 16 is a cut away perspective view of the casing of the machine shown in FIG. 15.
Figure 17:
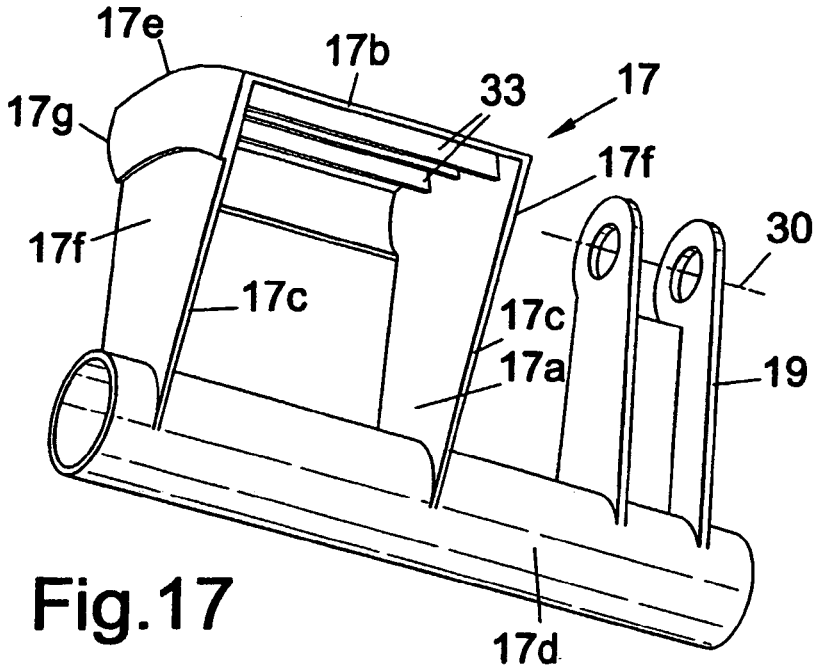
FIG. 17 is a perspective view of another embodiment of the vane member.
Figure 18:
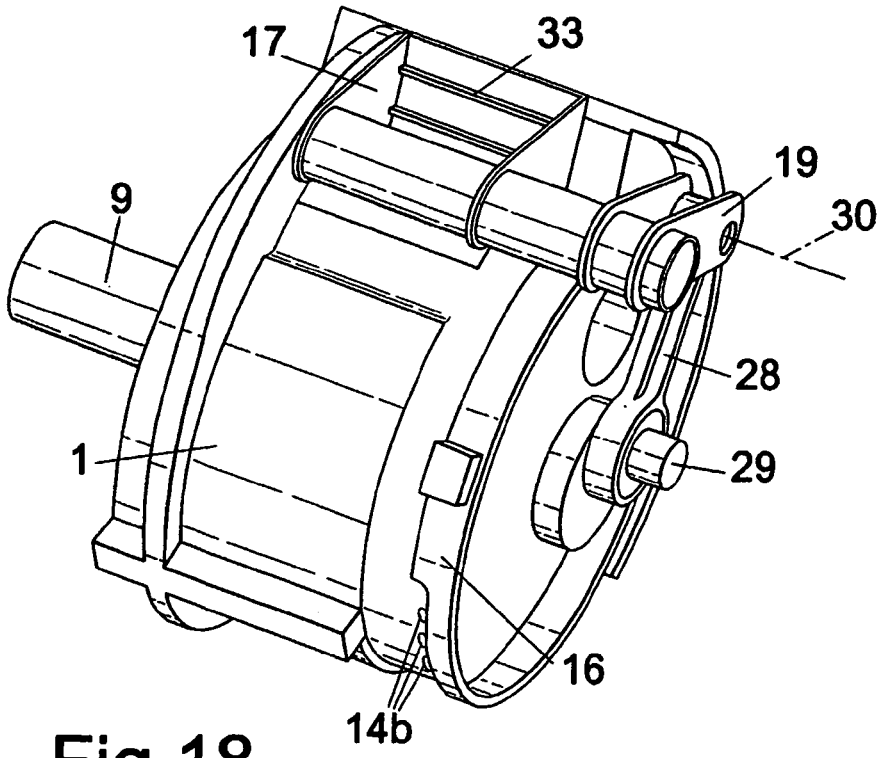
FIG. 18 is a perspective view of the machine.

FIG. 15 shows a diagrammatic representation of the position of the reed valve (one, two, or more may be fitted). FIG. 16 shows typical reed valve positions. FIG. 17 shows a modified vane member 17 with strengthening ribs 33. FIG. 18 shows the slide ring 16 and some of the evacuation holes 14*b*.

It will be appreciated from the above description and reasoning for the outlet valves, that the same can be applied to the compression of refrigerants in a heat pump.

However, an engine configuration as just described where the engine size is substantially reduced for a given power output also has a maximum power output; this maximum power is limited by the requirement to have no throttling at the lowest power requirement. Most of an automotive engine's power is required for acceleration. Present day vehicles can have larger engines to enable faster acceleration, but this means more throttling at low power and a reduced efficiency. Engine configurations as just described, for present day conventional vehicle weights, have sufficient power to accelerate them from 0 to 100 kilometres per hour in a time of between about 8 and 10 seconds. Where acceleration times less than this are required more power is needed. This can be provided by an electric motor or higher powered larger engine, but with a higher powered engine low power engine throttling will occur and will need to be recovered to avoid losses. If a supercharger of the type described herein is designed for the larger engine size and also to recover throttling losses, the mass of air leaked between close fitting parts with conventional clearance will be a substantial proportion of engine air mass flow under high engine inlet manifold vacuum conditions. Reducing the running clearance adds to the manufacturing cost. An alternative to reducing the running clearance and at the same time to reduce the complexity and cost of providing extended throttle loss recovery is to provide multiple superchargers/throttle loss recovery turbines. If two superchargers/turbines were used to provide air for one engine and only one of them was used at low power conditions, the clearance volume would be reduced by half and at the same time engine inlet manifold vacuum conditions should be provided.

The present invention provides a means of efficiently providing airflow to an internal combustion engine over the range from supercharge pressure to below ambient pressure by using two or more superchargers/throttle loss recovery turbines. It is proposed to use a combination of two or more superchargers/turbines with an internal combustion engine and an exhaust turbine. A heat exchanger may be used to alter the temperature of the air entering the internal combustion engine. The exhaust turbine may drive a compressor or electrical generator or both. The enabling technology to permit efficient use of this combination of components is the use of a supercharger/turbine of the type and incorporating any compatible features described herein. Compatible features are defined as features that those skilled in the art would combine together. For example, overall efficiency or manufacturing cost could determine whether reed valves may, or may not, be provided.

The supercharger's airflow control allows the supercharger delivery pressure to be varied from above ambient pressure to below ambient pressure. If there were two superchargers providing air to one engine and they were controlled to provide ambient delivered pressure to the engine, the engine would then have a cylinder and inlet manifold at ambient pressure. If flow from one of the superchargers was prevented from entering the engine the volume of airflow would be halved and the cylinder and inlet manifold pressure reduced to about 38 kPa. The superchargers could be driven independently of the engine and of each other or directly from the engine; if the one supplying air to the engine was independently driven by, say an electric motor, its speed could be reduced relative to the engine and thereby provide a lower delivery pressure. The supercharger not supplying air to the engine can be set to provide ambient pressure and continue to rotate and so circulate air to and from atmosphere without any meaningful pressure rise or work, or it could be disconnected.

The vane member 17 of the superchargers are actuated by a reciprocating motion. This gives rise to an out of balance force. The primary out of balance forces can be balanced, leaving a secondary force that can be acceptably low. However, as bigger rotor offsets and higher speeds are designed the secondary out of balance requires balancing. This can be simply achieved by adding two linked arms (balanced links) to the supercharger. A consequence of providing multiple superchargers for an engine is the ability to position them so the out of balance forces can oppose each other, thus eliminating the need for linked balance arms. However, installation requirements may mean that two or more superchargers cannot be placed in the optimum position for balance, making balance links necessary when multiple superchargers are used to reduce any out of balance couple.

Figure 19:
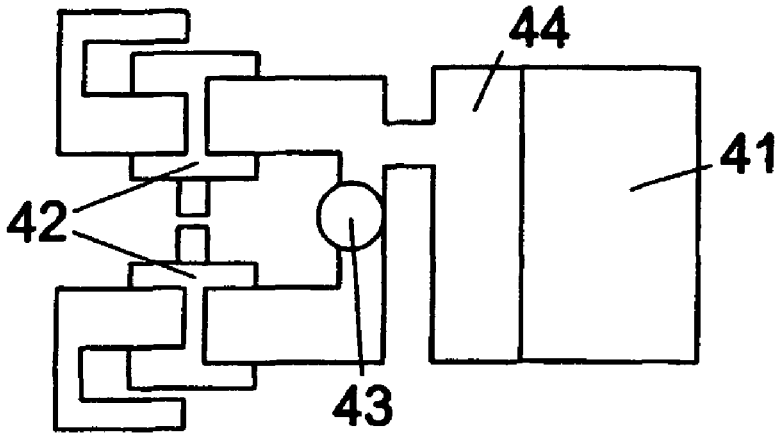
FIGS. 19 to 22 are diagrams are four different engine systems incorporating rotary positive displacement machines functioning as superchargers/throttle loss recovery turbines.
Figure 20:
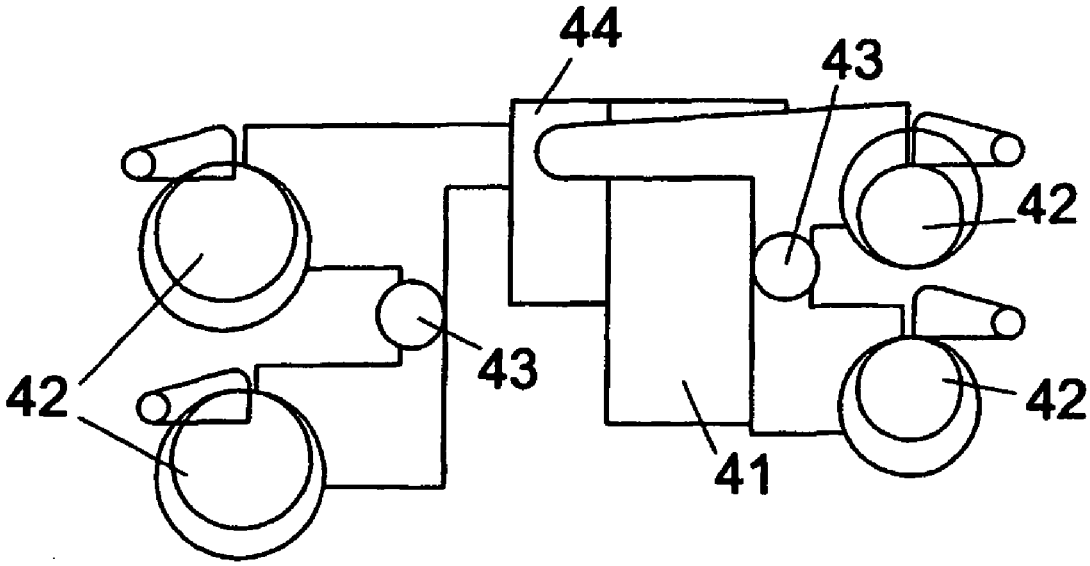
Figure 21:
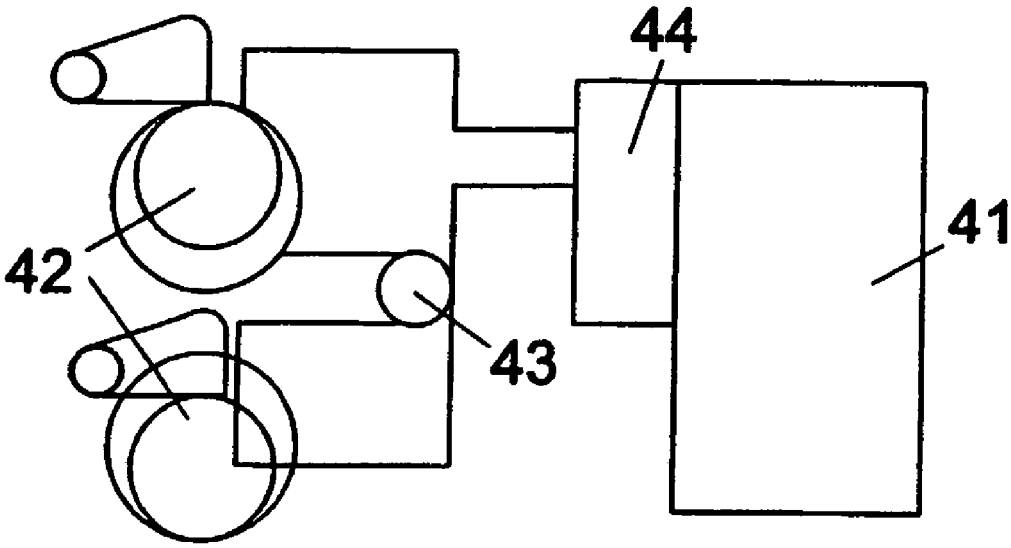
Figure 22:
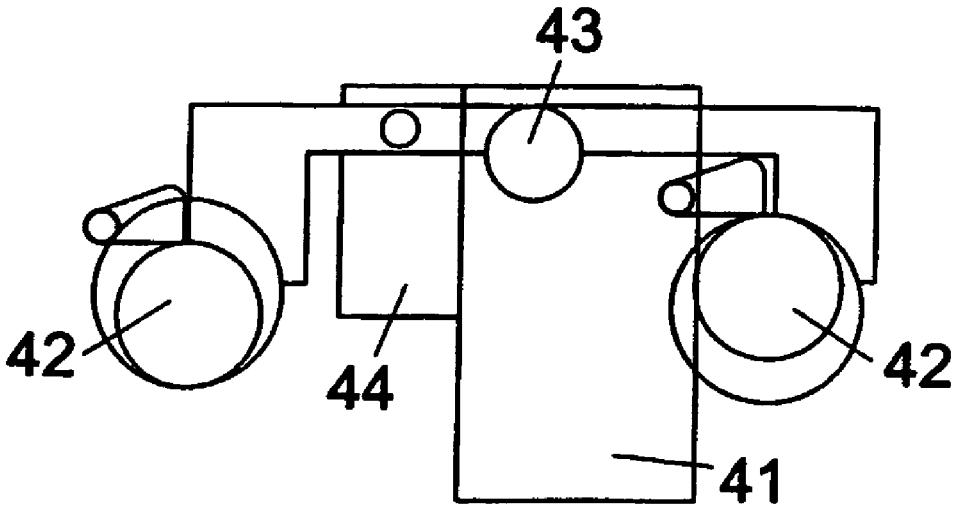
Figure 23:
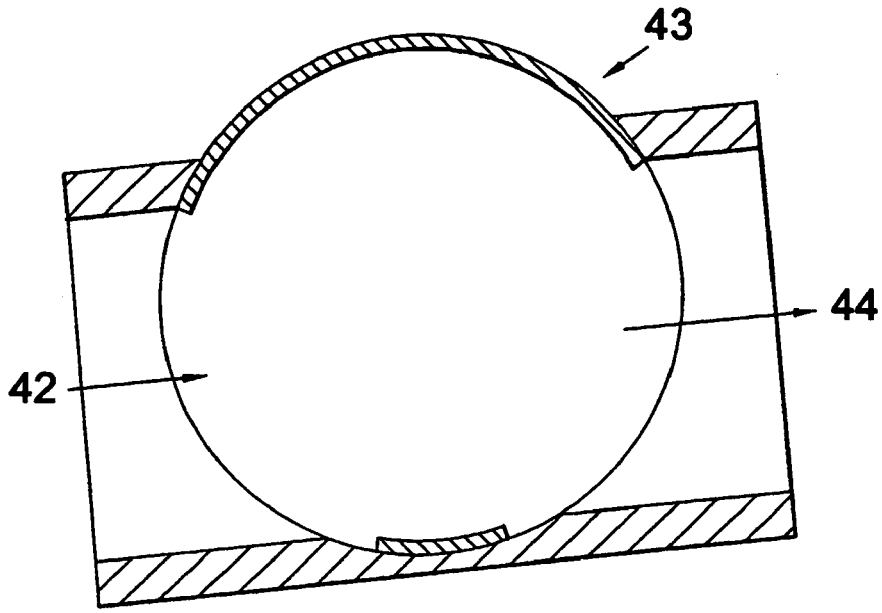
FIG. 23 shows a typical cross-section of a valve for controlling the direction of airflow from one supercharger/turbine to the engine inlet manifold.
Figure 24:
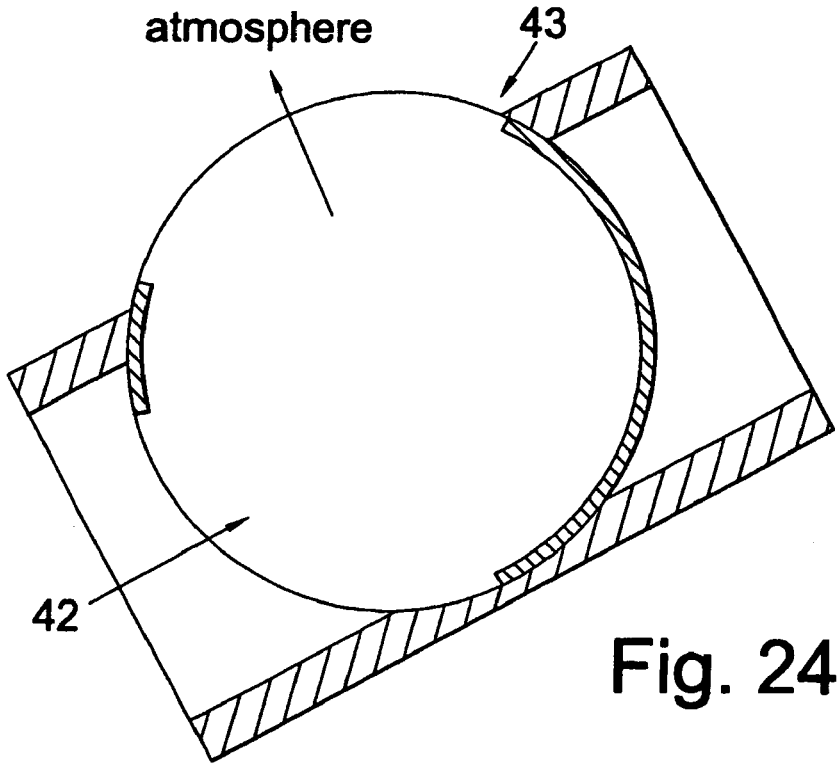
FIG. 24 is similar to FIG. 23, but shows the valve directing the airflow to the atmosphere.
Figure 25:
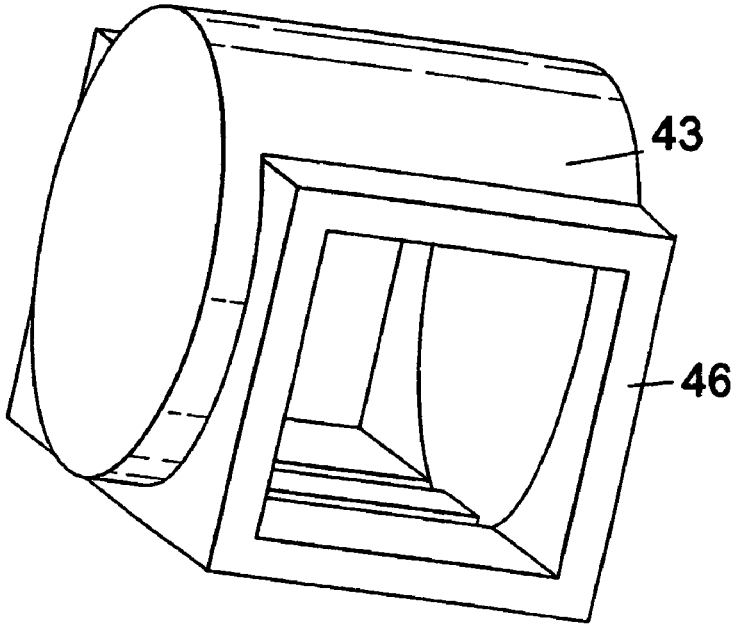
FIG. 25 is a perspective view corresponding to FIG. 23.
Figure 26:
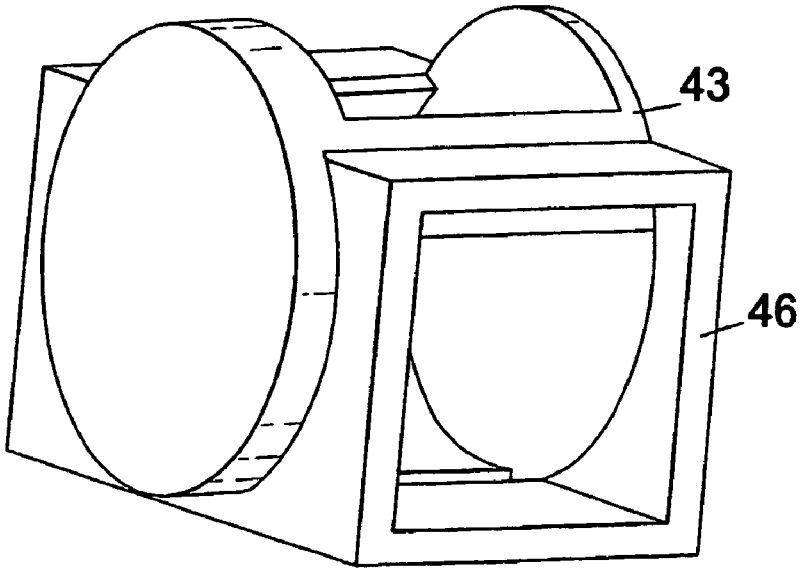
FIG. 26 is a perspective view corresponding to FIG. 24.
Figure 27:
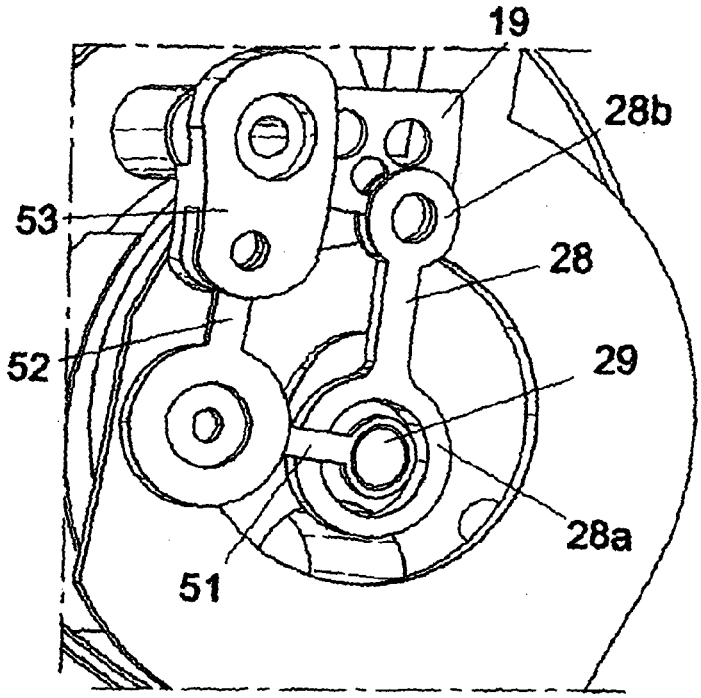
FIG. 27 is a partial perspective view of another embodiment of a rotary positive displacement machine, with balancing links.
Figure 28:
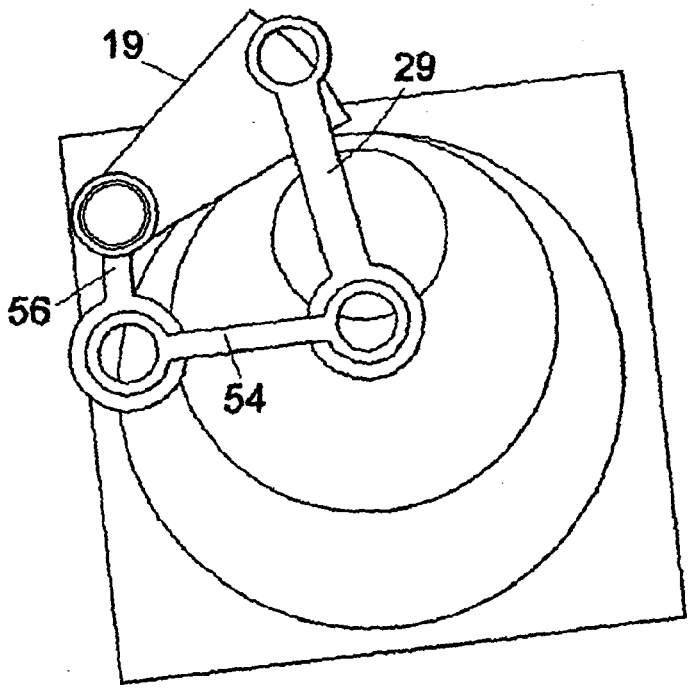
FIG. 28 is an end view of another embodiment of the machine, showing a different arrangement of balance links.

FIG. 19 shows a diagrammatic view on top of an engine 41 with two superchargers/throttle loss recovery turbines 42 (as described above) one of which is connected by a valve 43 to the engine inlet manifold 44. FIG. 20 shows a diagrammatic view on the front of an engine 41 with four superchargers/turbines 42. FIG. 21 shows another diagrammatic view on the front of an engine 41 with two superchargers/turbines 42 in another arrangement. FIG. 22 shows a diagrammatic view on the front of an engine 41 with two superchargers/turbines 42 in another arrangement. FIG. 23 shows a typical cross-section of a valve 43 for controlling the direction of airflow from one supercharger/turbine 42 to the engine inlet the manifold 44. FIG. 24 shows the valve 43 directing airflow from the supercharger/turbine 42 to atmosphere. FIG. 25 shows a portion of ducting 46 and a typical valve 43 for controlling the direction of airflow from one supercharger/turbine to the engine intake manifold. FIG. 26 shows the valve 43 directing the airflow from the supercharger/turbine to atmosphere. FIG. 27 shows typical linked balancing arms 51,52 and a fixed arm 53. FIG. 28 shows typical linked balancing arms 54,56 in another balancing arrangement.

The diagrammatic views of FIGS. 19 to 22 are only illustrative of four of a number of possible configurations. The positioning of the superchargers/turbines will be influenced by the inallation requirements of the vehicle and the position and types of supercharger drive and the requirement for counter balance.

FIGS. 23 and 24 show a typical cross-section of a valve 43 that can divert the airflow from a supercharger/turbine 42 to either atmosphere or the engine inlet manifold 44. A number of valves known in the art can provide this function. The valve's main requirements are to provide a flow with minimum aerodynamic and thermodynamic losses and to provide a seal against ingress or egress of air from the engine manifold and supercharger/turbine. The valve shown is perhaps the easiest and least costly to manufacture. The valve is circular and tubular and has substantial circumferential lengths for sealing and is required to rotate backwards and forwards by about 130 degrees.

The supercharger/turbine shown in FIG. 28 has two balance arms 54,56 linked together that provide a balance for any secondary out of balance forces. It is convenient both from a cost point of view and because of the close proximity of the plane of the secondary out of balance, to have one arm mounted on the axis of the connecting rod centre and the other arm on the pivot axis of the vane member. FIG. 27 shows an alternative position for locating one end of one of the balance arms.

One or more of the above described machines used as a supercharger may be used to recover throttle loss, as described in U.S. Pat. No. 6,226,986, the rotor being driven by the pressure difference between ambient air and air at the inlet manifold, the machine being operatively connected to an energy-using device.

A preferred embodiment of the machine according to the invention provides a means of increasing the efficiency of the compressor in supercharger mode and the turbine in throttle loss recovery mode. It also extends the applicability of the machines described above to diesel engine charging and exhaust gas treatment.

Figure 29:
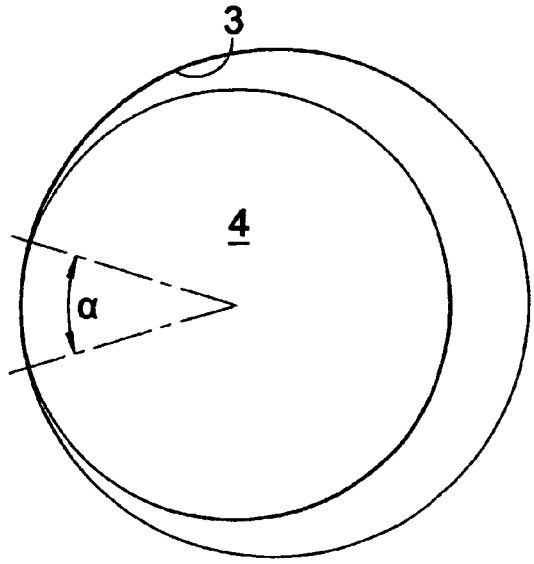
FIG. 29 is a diagram showing the relationship between the external surface of the rotor and the internal surface of the casing.
Figure 30:
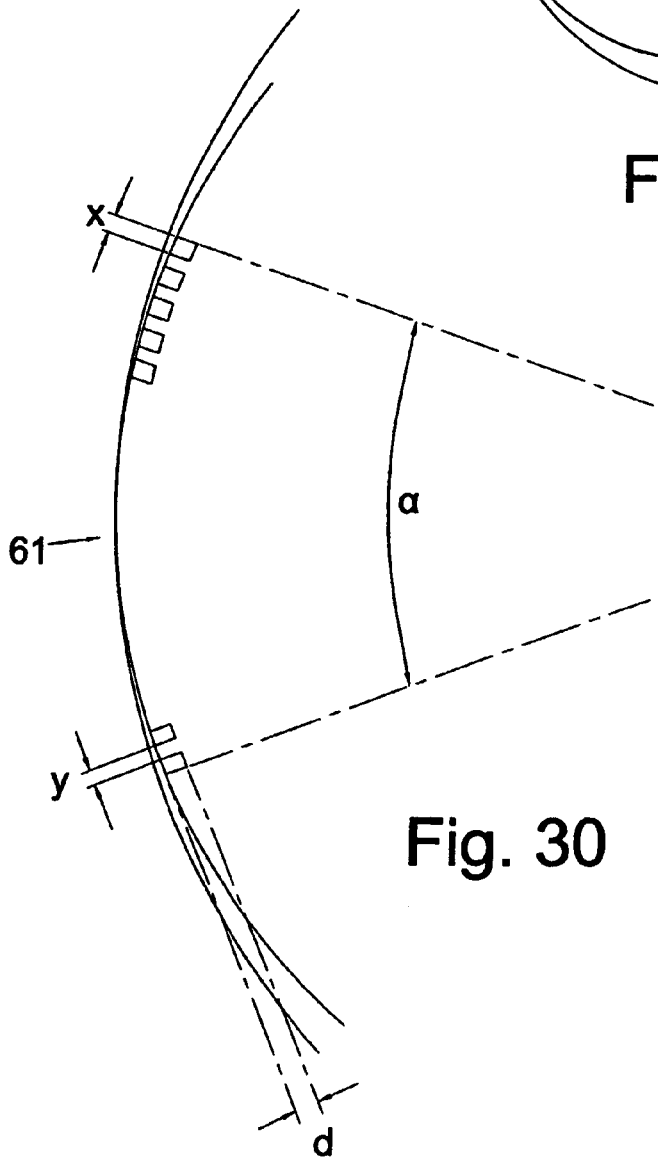
FIG. 30 is an enlarged detail of FIG. 29, showing a labyrinth seal.
Figure 31:
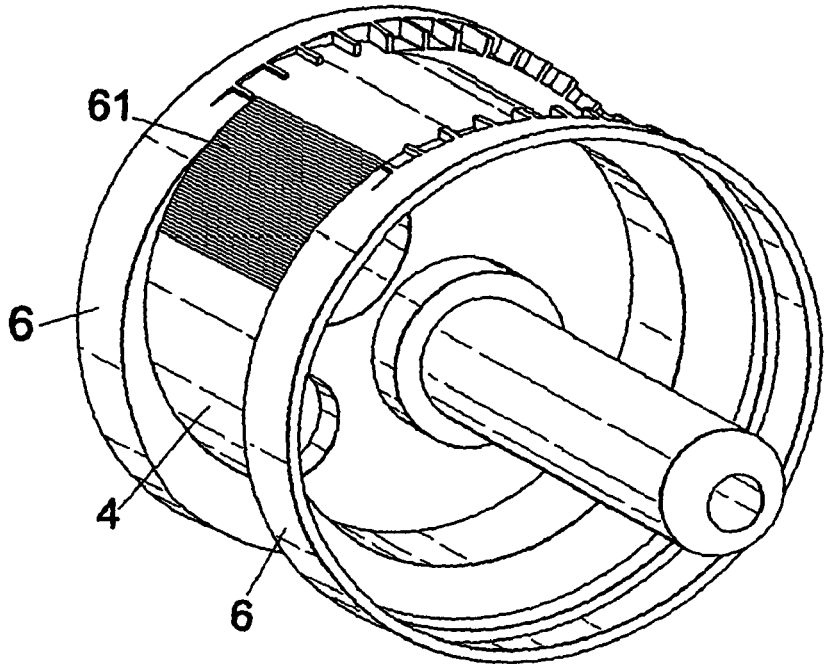
FIG. 31 is a perspective view of the rotor and associated parts, showing the labyrinth seal.

Labyrinth seals are well known in the art and are known to reduce the flow of gases and vapours when one part is in close proximity to another. In the present case (see FIGS. 29 to 31) the tip of the rotor 4 is in close proximity to the mating surface 3. By forming a labyrinth seal 61 in the rotor 4 and optionally in the side discs 6 and extending over an arcuate distance both on the leading and trailing side of the piston tip, the leakage of fluid between the piston and casing and for a time between the piston and the articulated vane is reduced. Leakage across the length of the periphery of the side discs will be reduced if a labyrinth seal is formed circumferentially in the disc peripheral surface. Labyrinth seals are most effective if the width x of the groove and the groove depth d are the same dimension and the width y of the fin defined between grooves is less than the groove width x. The angular extent, $\alpha$, of the labyrinth seal is typically 40°, as shown in FIG. 30.

Modern diesel engines are perceived as producing too much nitrogen oxides and too much particulate matter that is passed into the atmosphere from their exhaust. The diesel engine is conventionally a compression ignition engine. The engine compression ratio is usually determined by the need to produce sufficient compression temperature to start the engine on a cold day. When the engine has reached running temperature the high compression needed for starting could be reduced and this would also reduce the pressure inside the cylinder. With a reduced cylinder pressure the fatigue life of the engine material would be increased, so the engine could be made lighter for the same fatigue life as at present.

By using a supercharger of the type described, variable boost pressure could be supplied to the engine to provide cold start and normal running pressure desirable conditions. The ability of the superchargers described above to pass air out through the evacuation orifices or out through the outlet orifices to the engine manifold means that either of these outlets could be used to supply air directly to the exhaust system for treatment of exhaust emissions. One possible exhaust gas treatment is to absorb nitric oxides and particulates and to burn them off sequentially, a supply of pressurised air for this purpose is most desirable.

Figure 32:
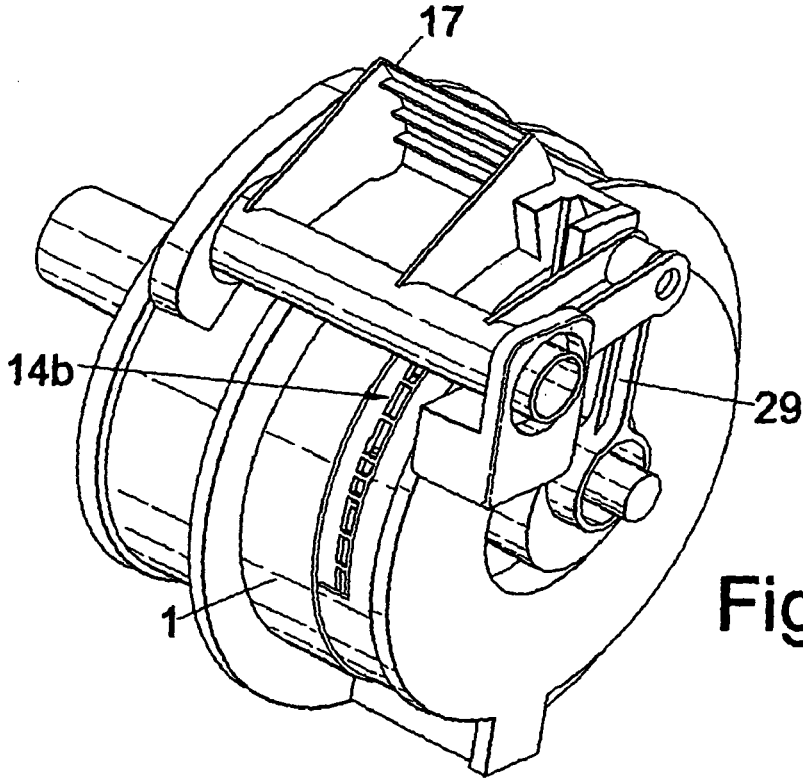
FIG. 32 is a perspective view of another embodiment of a rotary positive displacement machine, for use as a supercharger.
Figure 33:
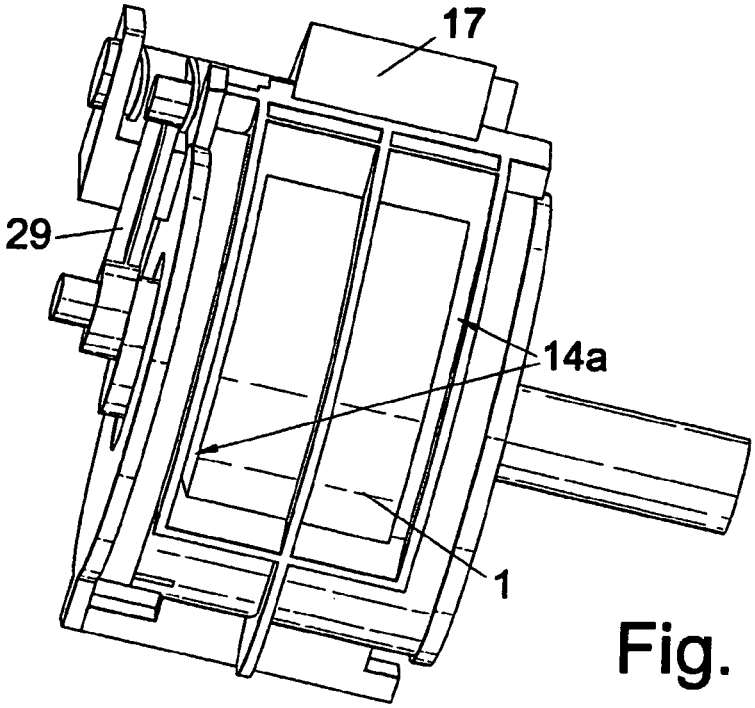
FIG. 33 is another perspective view of the machine shown in FIG. 32.

FIG. 32 shows evacuation orifices 14*b* that could supply air for exhaust treatment. FIG. 33 shows exit orifices 14*a* that could supply air for exhaust treatment.

As the rotor 4 orbits, air that is pushed out of the evacuation holes 14*b* could be pushed into the exhaust system to supply oxygen for treatment of the exhaust gases. If the air supply pressure requirement was low, say at a pressure of 20 kPa above atmosphere, the efficiency of pushing the air up to this exhaust system pressure would be reasonably high at about 80%, but because this type of compression is like a Roots compressor, with no internal compression, the efficiency would be about 40% if the pressure requirement was, say, 100 kPa above atmosphere. Therefore for higher pressures it would be more efficient to supply the air from the manifold outlet side of the machine where, because there is internal compression to pressurise the air, the compression efficiency is near 90%.

Machine efficiency is improved by reducing leakage between high and low pressure regions by incorporation of a labyrinth to restrict the leakage flow.

In the above-described machines the position of the orbiting rotor 4 in relation to the vane member 17 is always changing and a single point on the surface 11 of the rotor 4 is always sweeping the bore of the casing 1 or the tip of the vane member. The leakage of fluid between the casing 1 and rotor 4 is controlled by the gap between the two parts, the circumferential length of the gap, and the effectiveness of any labyrinth seal. The leakage between the vane member and the rotor is controlled largely by the gap and circumferential length of the gap. The circumferential length of gap between the vane member and rotor is small compared to the circumferential length of the gap between the casing and the rotor because the vane tip radius curves in the opposite direction to the rotor surface 11, whereas the casing surface 3 curves in the same direction as the rotor surface 11. The size of the minimum gap between the rotor and the casing and vane member is determined by the need to allow for thermal expansion and for deflections caused by mechanism operational stresses. It would be desirable to find a way of increasing the circumferential length of the gap between the vane member and rotor and to mitigate the effects of thermal and mechanism load deflections.

In a preferred embodiment the present invention (FIGS. 34–41) the part 4*a* of the rotor that would have been in close proximity to the casing and vane is reduced in diameter and to the reduced diameter inner part 4*a* is fitted a bearing (not shown) and to the outer diameter of the bearing is fitted a ring-shaped outer part 4*b* and a fixed appendage 71 to the ring 4*b* is attached to the vane member 17. A bearing allows the attachment of ring 4*b* and vane member 17 to pivot in relation to each other. Because they are allowed to pivot in relation to each other the ring or outer rotor part 4*b* can be shaped in the local area of the vane member 17 as a curved recess 72 to provide a substantial circumferential gap length between the tip face 17*g* of the vane member and the ring. The gap between the ring 4*b* and the casing 1 is substantially unchanged by fitting the bearing and ring.

Creating a labyrinth seal over the whole of the ring's circumference is likely to reduce leakage between ring and casing.

Figure 44:
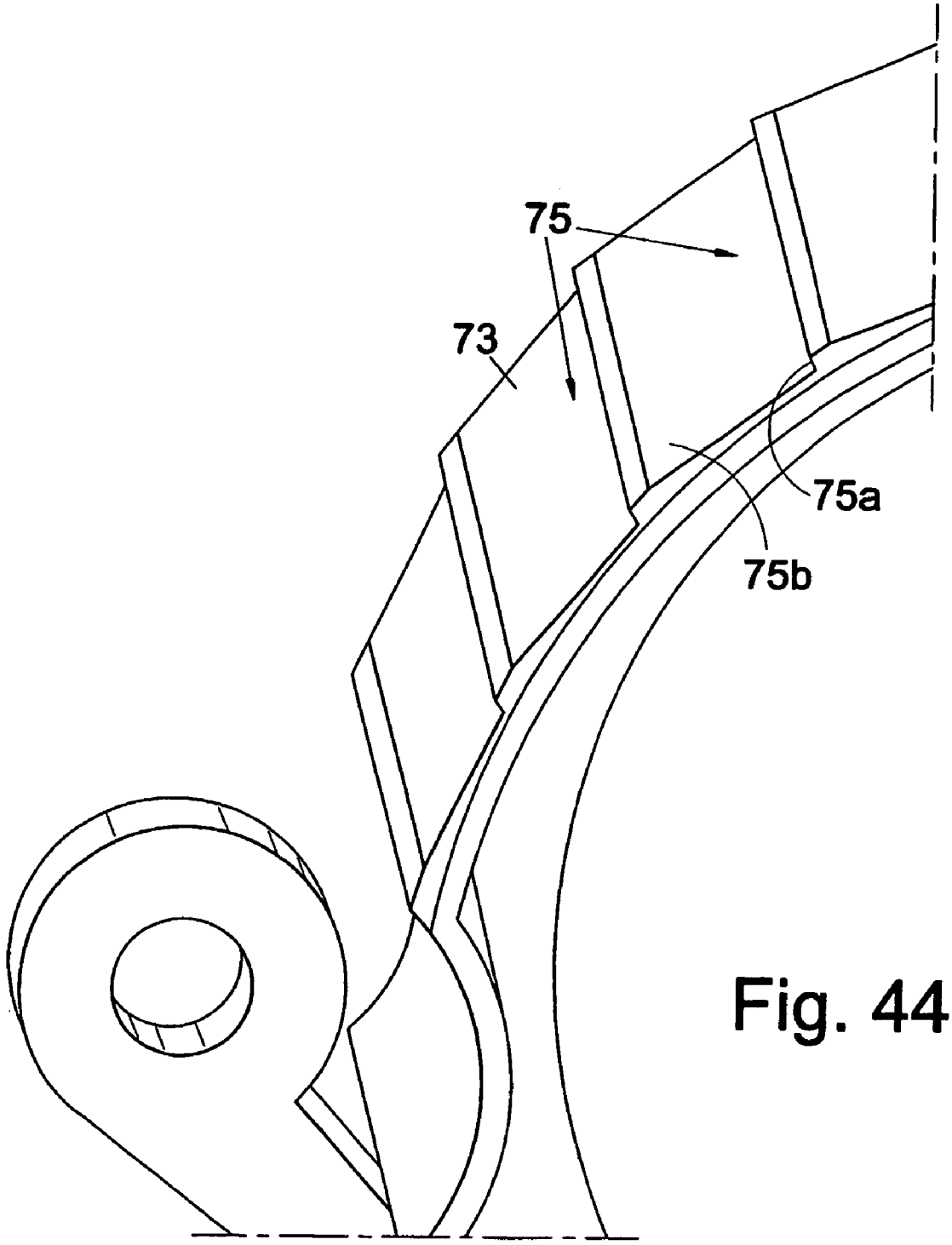
FIG. 44 is a perspective view of part of a rotor with a coating of compliant material.
Figure 45:
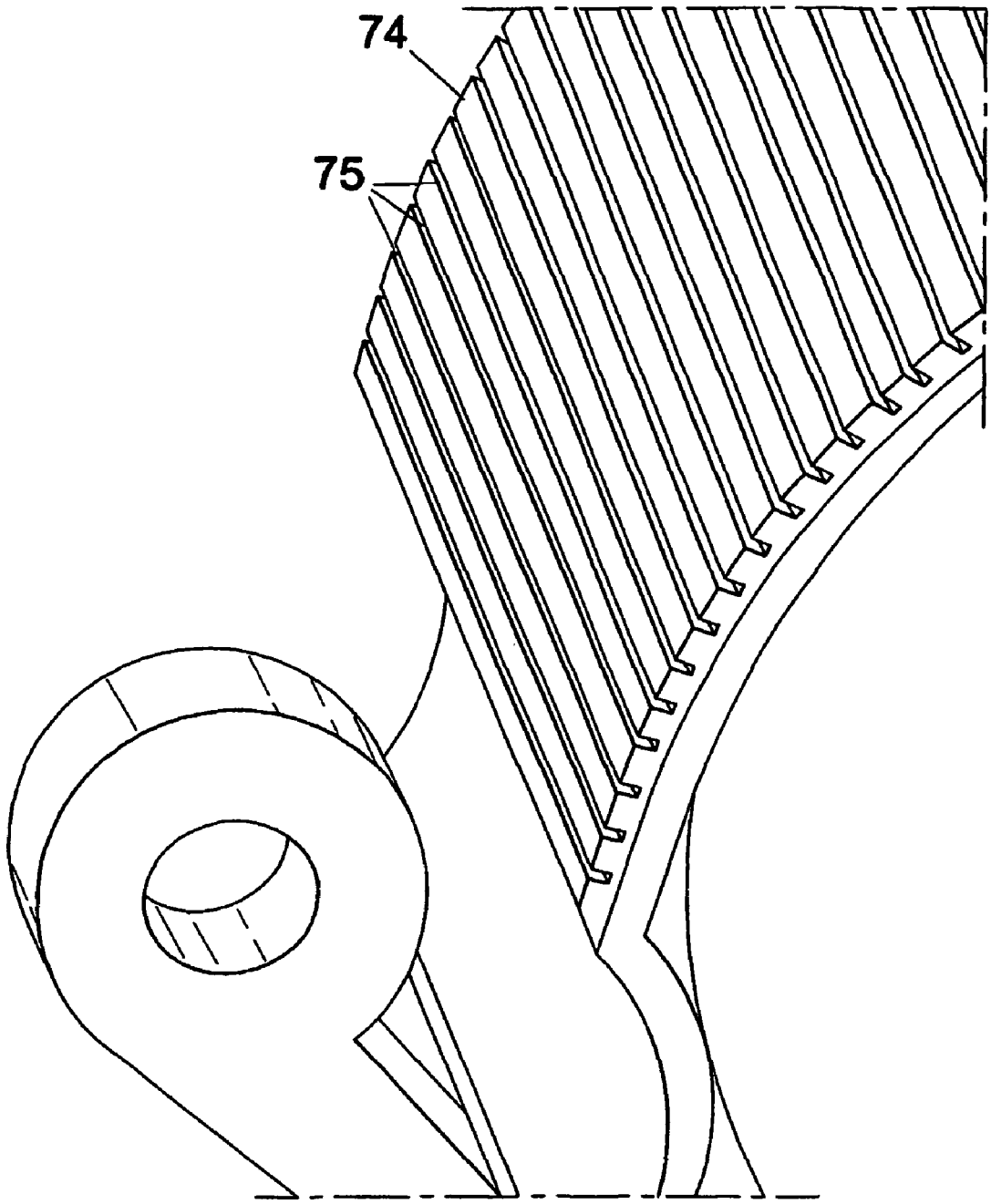
FIG. 45 is similar to FIG. 44, but showing a different form of the coating of compliant material.

In addition or as an alternative to a labyrinth seal, the ring's outer surface could be coated with a compliant material 73 or 74 as shown in FIG. 44 or 45. The compliant coating 73, 74 could be rubber like the tyres of vehicles. The amount of differential thermal expansion and mechanical stress deflection is likely to be less than 200 microns and therefore a compliant coating that could be compressed by this amount would be sufficient; components could be assembled with this built-in compression. As shown in FIGS. 44 and 45, the compliant coating 73 or 74 is provided with axial grooves 75, which enhance the deformability of the coating. In FIG. 44 each groove 75 has one steep sidewall 75*a* and one gradually sloping sidewall 75*b*.

Figure 34:
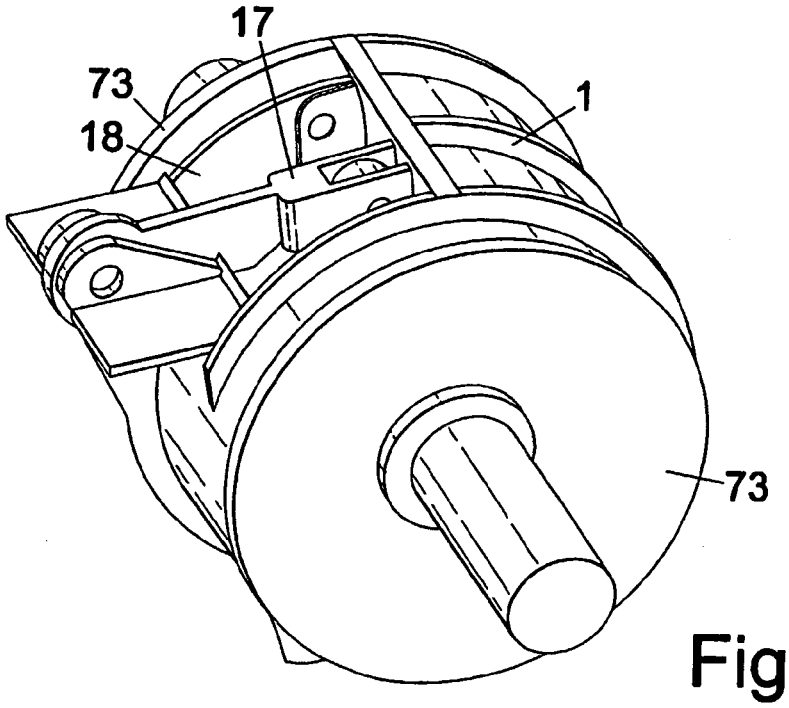
FIG. 34 is a perspective view of another embodiment of a machine in accordance with the invention, in which the arrangement of the vane member is different from the previous embodiments.
Figure 35:
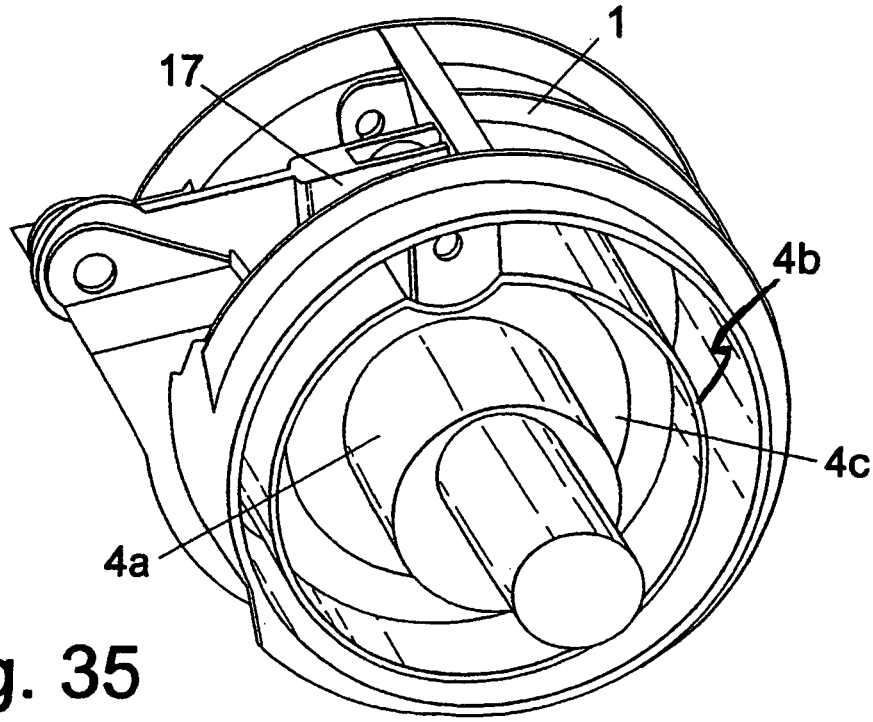
FIG. 35 is similar to FIG. 34, but with end covers and side discs removed.
Figure 36:
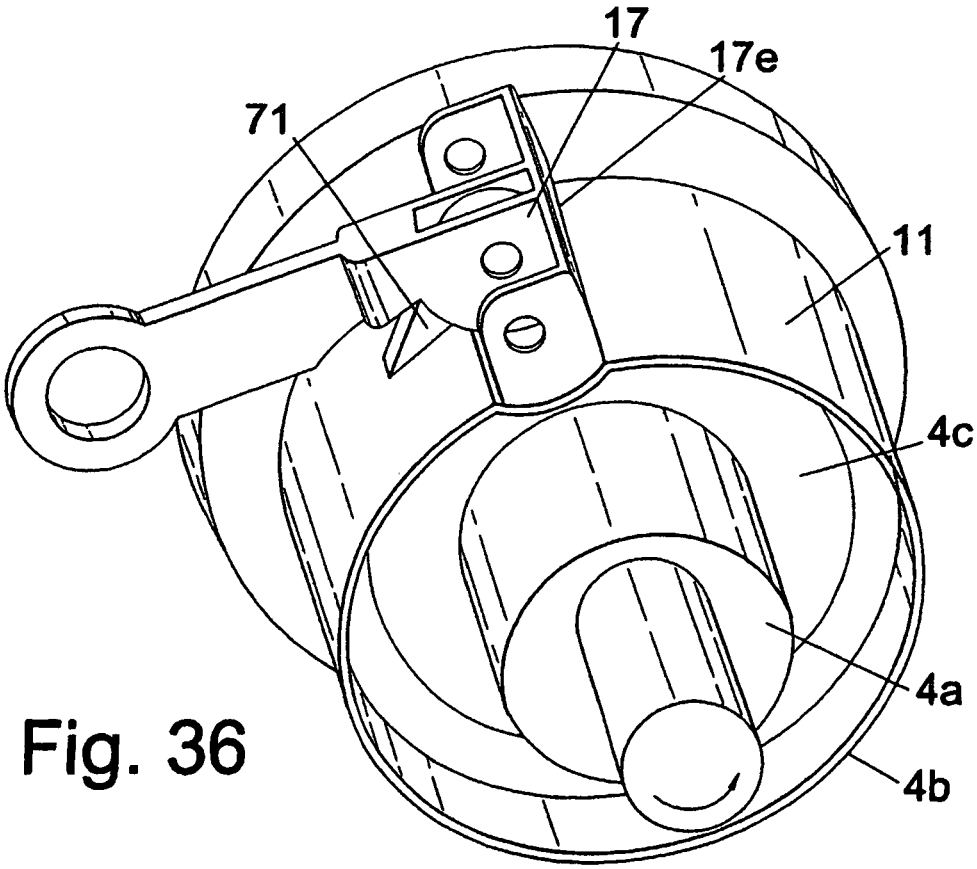
FIG. 36 is an enlarged perspective view similar to FIG. 35, but with the casing removed.
Figure 37:
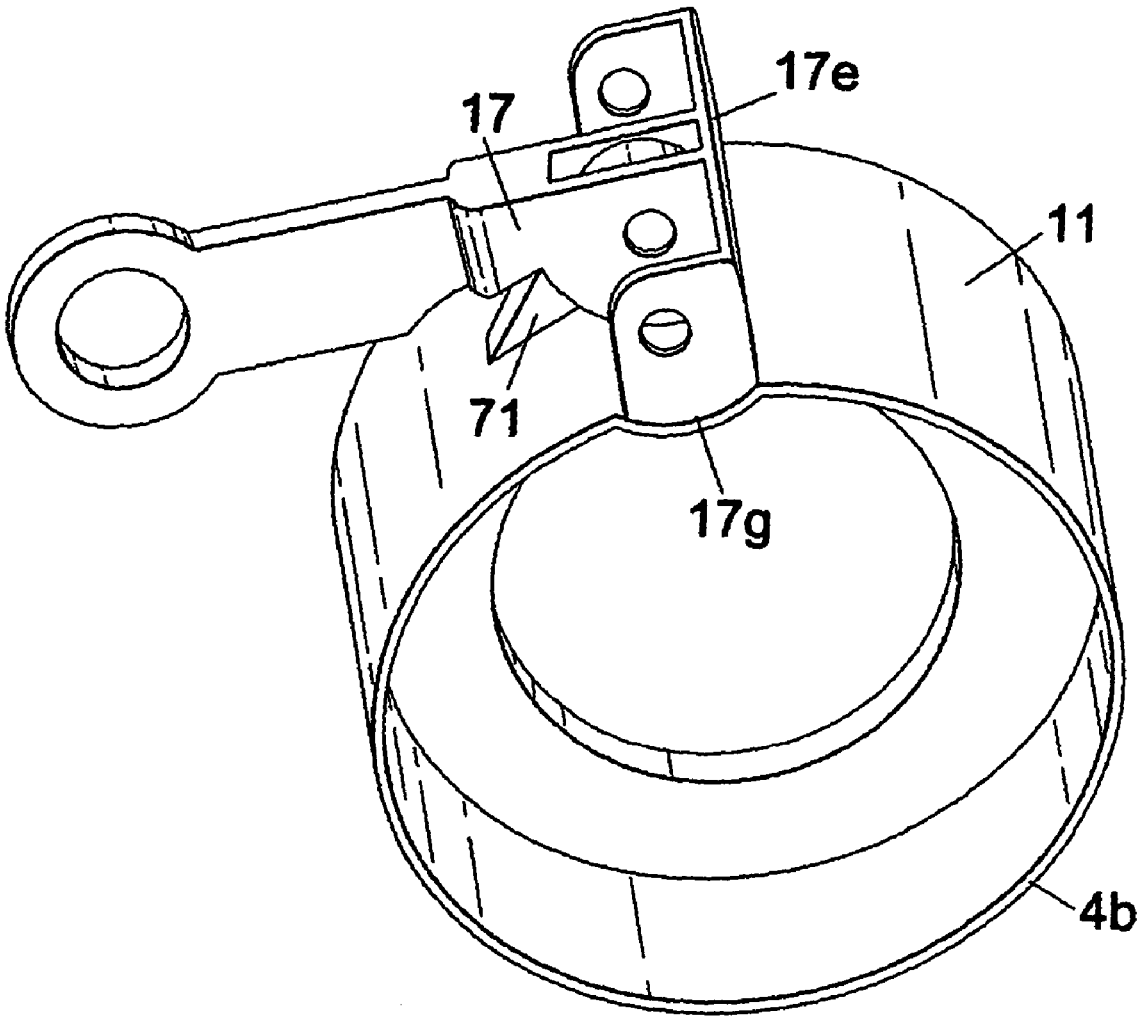
FIG. 37 is a perspective view showing the relationship between the vane member and the outer part of the rotor.
Figure 38:
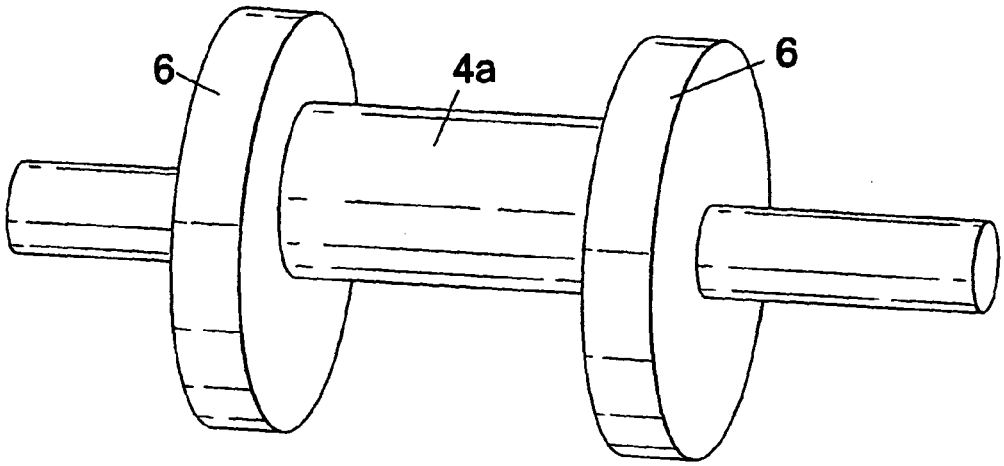
FIG. 38 is perspective view of an assembly comprising the inner part of the rotor and two side discs.
Figure 39:
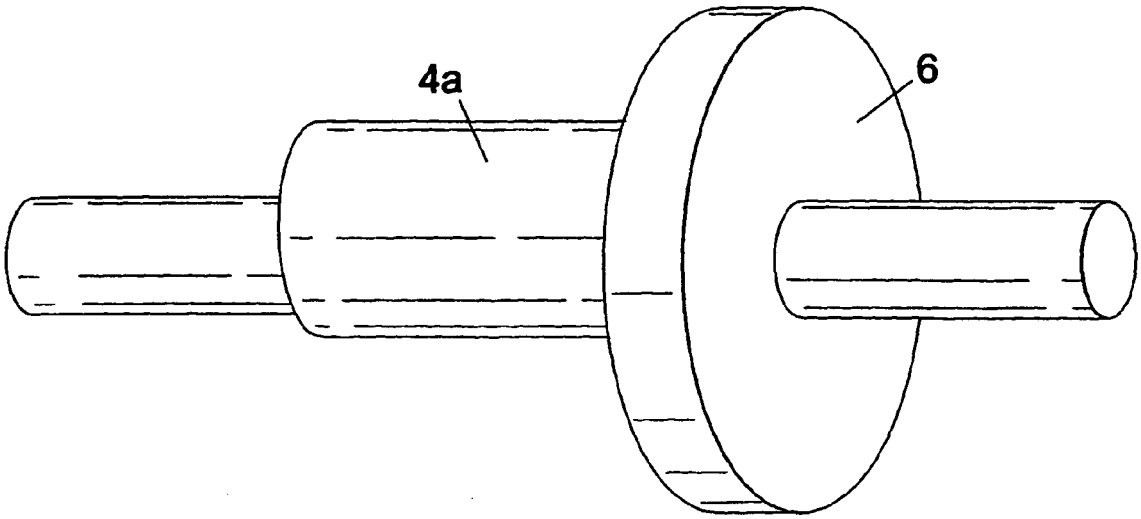
FIG. 39 is similar to FIG. 38, but with one of the side discs removed.
Figure 40:
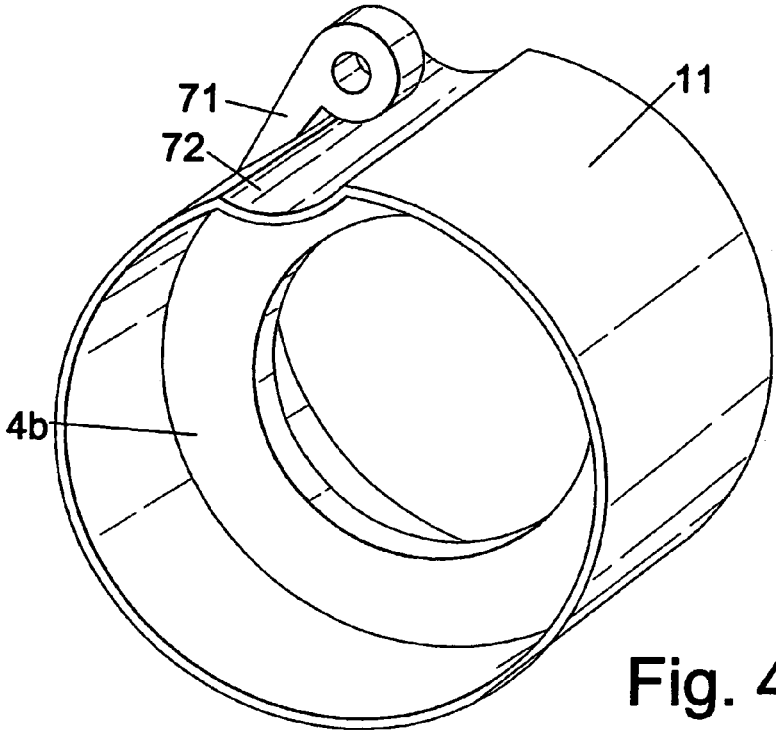
FIG. 40 is a perspective view of the outer part of the rotor.
Figure 41:
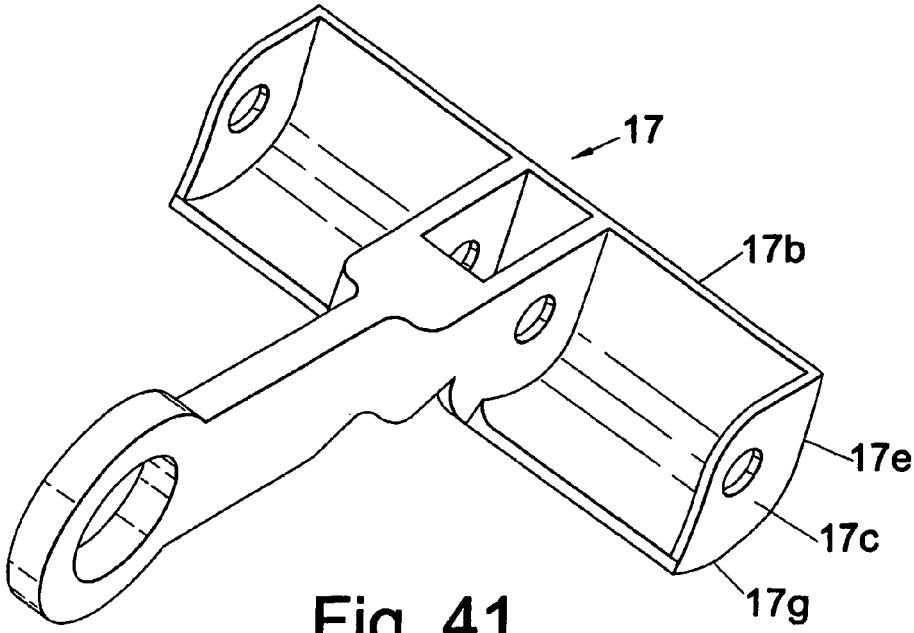
FIG. 41 is a perspective view of the vane member.
Figure 42:
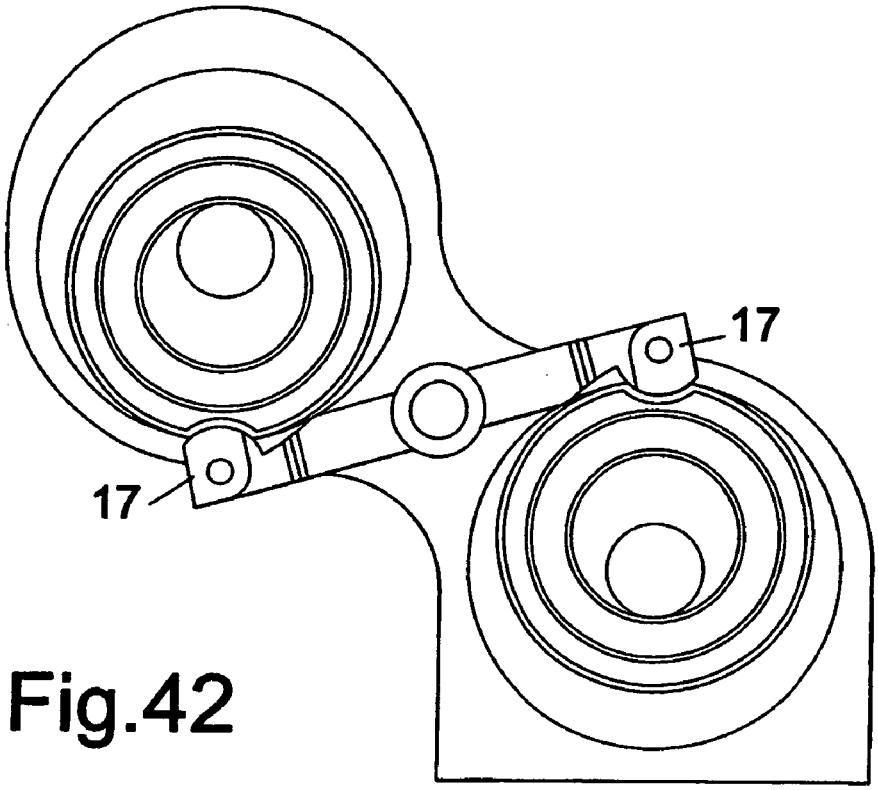
FIG. 42 is a schematic end view of a pair of machines in which the vane members are combined.
Figure 43:
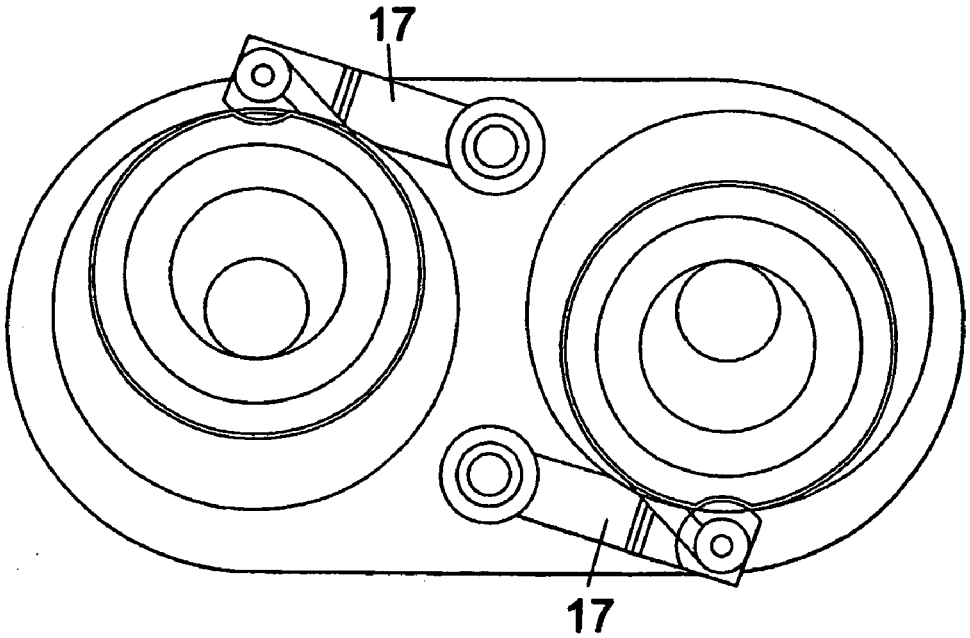
FIG. 43 is a schematic end view of a pair of machines in which the vane members are separate.

The arrangement with the outer rotor part 4*b* attached to the vane member 17 produces a rolling motion between the ring-shaped part 4*b* and the casing the outer rotor part 4*b*, and mechanical losses associated with this motion are like the rolling resistance losses of a wheel and are caused by the cyclic compression of the compliant coating. These losses are small compared to the gain in efficiency made by the reduced leakage. The relationship between the vane tip and ring is a sliding motion and will provide some friction if there is not a positive clearance; the increased circumferential length of the gap and the possibility of providing a labyrinth seal at this point will substantially reduce leakage at this point FIG. 40 shows the ring-shaped outer part 4*b* with fixed appendage 71 and local recess 72 conforming to the vane tip curve. FIG. 41 shows a vane member 17. FIG. 37 shows the assembly of ring and vane member. FIG. 39 shows the inner rotor part 4*a* with one disc removed. FIG. 36 shows an assembly of vane member, ring, inner part, and ring bearing 4*c*. FIG. 35 shows the assembly as FIG. 36 with the casing 1 fitted. FIG. 38 shows the inner rotor part 4*a* with both side discs 6. FIG. 34 shows an assembly as FIG. 35 with both side discs 6 and end covers 73 fitted. FIG. 42 shows how two units could be arranged in relationship to each other. FIG. 43 shows two units in an alternative arrangement to FIG. 42.

With the piston rotating as shown in FIG. 36 the closest position of the ring 4*b* to the casing bore rotates with the eccentric inner part 4*a*, the ring is constrained by its attachment to the vane member 17 to move within the limits defined by the vane member 17 pivoting about its attachment to the casing 1 and the centre of the offset axis of the rotating part 4*a*.

FIG. 42 shows a configuration of two units where the pivoting vane member 17 for both units can be one component and the reactions from the movement of both rings acting on a single bearing attachment to the casing cancel each other and substantially reduce the bearing stresses. FIG. 43 is an alternative arrangement of two units where vane to casing pivot bearing stresses are higher than those in FIG. 42.

Figure 46:
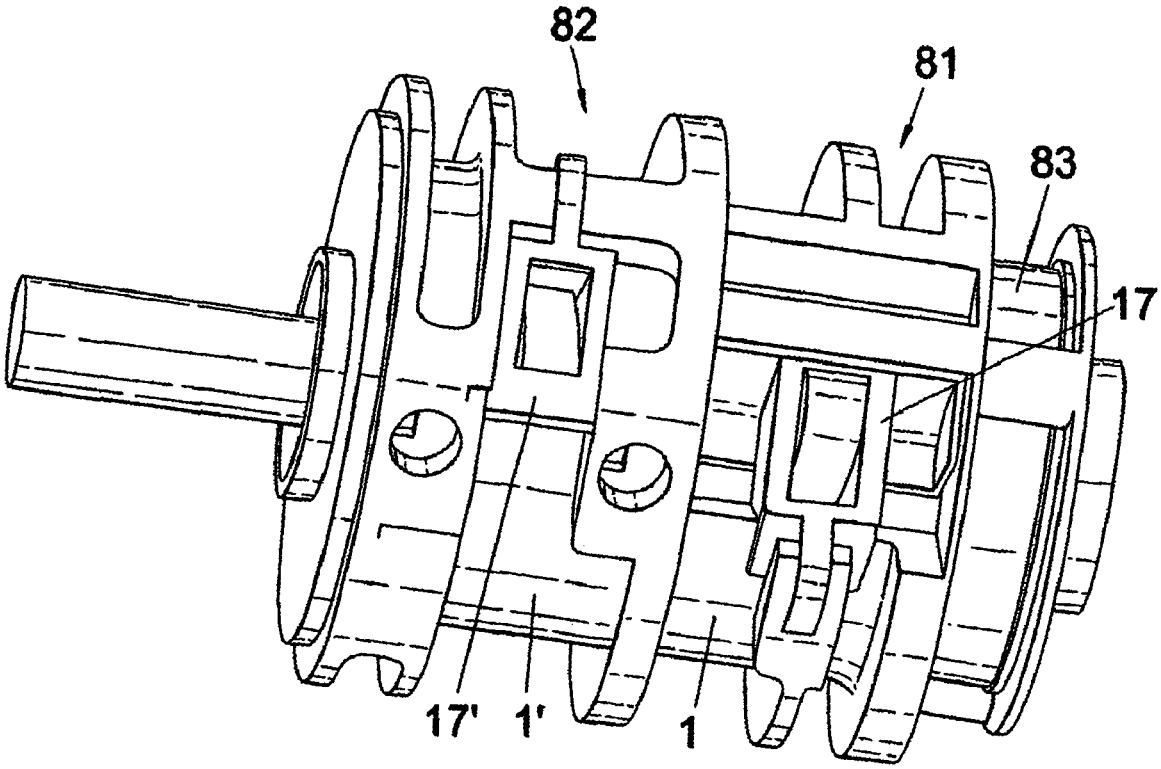
FIG. 46 is a perspective view of a combined compressor and expander for a heat pump.
Figure 47:
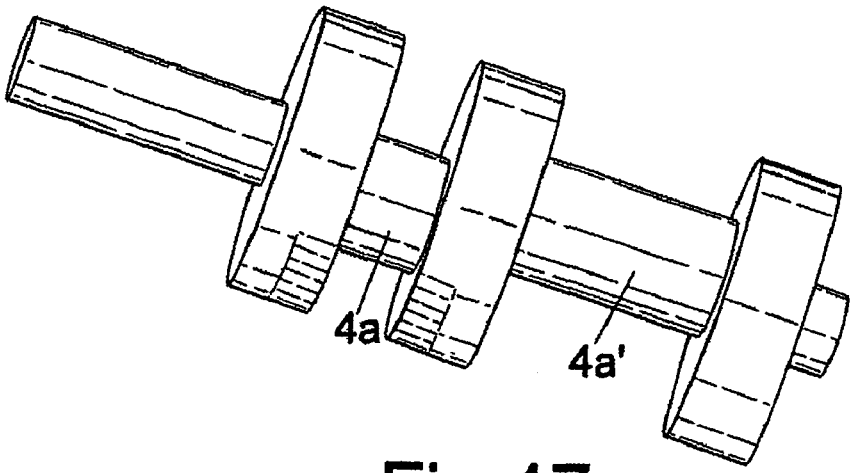
FIG. 47 is a perspective view of the shaft structure of the combined compressor and expander.

FIGS. 46 and 47 show a combined compressor 81 and turbine 82, each constituted by a rotary positive displacement machine as described above. Each individual compressor or turbine has a fundamental out of balance and needs to be balanced by either weighted links on each machine or running two machines with the out of balance forces opposing each other—as in the above-described automotive supercharger application.

In the case of the automotive supercharger/throttle loss recovery machine, the machine is performing one function at a time and not both together. In the case of the heat pump, both compression and expansion are being performed together.

By setting the compressor bearing centre axis offset from the centre of rotation in the opposite direction to that of the turbine expander, the unit can be balanced, as shown in FIG. 47. This is particularly useful in the case of the heat pump and may give greater flexibility in the case of the supercharger.

An additional feature shown in FIG. 46 is a slide ring 83. This can perform the same function for the heat pump as the slide ring 16 does in the supercharger, i.e. it allows the mass of the fluid which is compressed to be varied at any speed or pressure. This is particularly useful in heat pumps because as the heating or cooling requirement varies the slide ring can allow the requirement to be matched whilst maintaining a constant speed and delivery pressure.

The invention claimed is:

1. A rotary positive displacement machine comprising:

a casing having a circular cylindrical internal surface delimiting an operating chamber;

a rotor in the operating chamber, the rotor being mounted so as to orbit about a chamber axis which is the axis of the internal surface, the rotor having a circular cylindrical external surface, the chamber axis passing through the rotor, a generatrix of the external surface being adjacent to the internal surface, and a diametrically opposite generatrix being spaced from the internal surface;

a vane member mounted on the casing and being pivotable about a pivot axis parallel to the chamber axis, the vane member being accommodated in a fluid inlet/outlet aperture in the casing, the vane member having a passageway communicating between the exterior of the casing and the operating chamber, the vane member having an arcuate end face which is coaxial with said pivot axis and which has a length substantially equal to that of the rotor, the vane member having lateral faces extending from the respective lateral ends of the arcuate face towards said pivot axis, and the vane member having an arcuate tip face adjacent the rotor, said faces being sealing faces with respect to corresponding surfaces of the casing aperture and the rotor; and a linkage which connects the vane member to the rotor so as to keep the tip face of the vane member in sealing contact with the external surface of the rotor, the linkage being connected to the vane member by an articulation having an articulation axis such that a plane containing the articulation axis and the axis of the external surface passes through the region of sealing contact;

wherein the rotor comprises a rotating inner part and a non-rotating outer part;

wherein said non-rotating outer part has a shallow arcuate recess which receives the arcuate tip face of the vane member;

wherein the linkage comprises an appendage connected to said non-rotating outer part at a location between the vane member pivot axis and said arcuate recess and connected to the vane member by said articulation; and wherein said passageway traverses the vane member between the arcuate tip face and the pivot axis of the vane member.

2. A machine as claimed in claim 1, including a pair of discs at respective ends of the rotors, the discs rotating about the chamber axis in synchronism with the orbiting of the rotor and delimiting respective ends of the operating chamber.

3. A machine as claimed in claim 2, wherein at least one of the discs constitutes a shutter covering at least one inlet/outlet port in the casing, the shutter having at least one passage with a first end which is in the operating chamber and a second end which is outside the operating chamber and which periodically overlaps said inlet/outlet port as the shutter rotates.

4. A machine as claimed in claim 3, in which the second end of the passage is in the periphery of the shutter.

5. A machine as claimed in claim 4, in which the passage is in the form of a slot open at the inner face and the periphery of the shutter.

6. A machine as claimed in claim 3, in which there are a plurality of said passages arranged successively in the circumferential direction.

7. A machine as claimed in claim 3, in which there are a plurality of said inlet/outlet ports arranged successively in the circumferential direction.

8. A machine as claimed in claim 1, in which the casing has a plurality of fluid inlet/outlet ports.

9. A machine as claimed in claim 8, including means for selectively closing the fluid inlet/outlet ports.

10. A machine as claimed in claim 9, in which the closing means comprises a slider.

11. A machine as claimed in claim 10, in which the slider is in the form of a ring extending around the casing.

12. A machine as claimed in claim 1, in which said aperture in the casing extends from the surface corresponding to the arcuate end surface of the vane member, taken as 0°, over an angular range of up to 70°.

13. A machine as claimed in claim 12, functioning as a compressor, in which the fluid enters through the passageway in the vane member, and the casing has at least one evacuation orifice within an angular range of 140° from the end of said aperture.

14. A machine as claimed in claim 12, in which the casing has at least one exit orifice within the angular range from 240° to 360°.

15. A machine as claimed in claim 1, in which the casing has at least one exit orifice provided with a reed valve.

16. A machine as claimed in claim 1, in which the external surface of the rotor has axial grooves providing a labyrinth-type seal between the rotor and the casing.

17. A machine as claimed in claim 16, in which the groove depth is substantially the same as the groove width.

18. A machine as claimed in claim 16, in which adjacent grooves define between them a fin having a width less than the groove width.

19. A machine as claimed in claim 1, in which the external surface of the outer part of the rotor has a coating of a compliant material, the coating having a series of axially extending grooves which enhance the deformability of the coating.

20. A machine as claimed in claim 19, in which each groove has one steep sidewall and one gradually sloping sidewall.

21. A machine as claimed in claim 1, in which the linkage comprises a connecting link having one end articulated to an extension of the rotor on an axis coincident with the axis of the said external surface, and the other end articulated on the said articulation axis to a lever arm which is rigid with the vane member and which is pivotable about the said pivot axis.

22. A machine as claimed in claim 21, in which the linkage further comprises balance links connected between the said rotor extension and the pivot axis.

23. An engine system as claimed in claim 22, further comprising an exhaust turbine, preferably driving a compressor and/or a generator.

24. A combined compressor and expander, comprising respective machines, comprising an internal combustion engine having an inlet manifold, and at least one machine connected to the inlet manifold, wherein the at least one machine comprises:

a casing having a circular cylindrical internal surface delimiting an operating chamber;

a rotor in the operating chamber, the rotor being mounted so as to orbit about a chamber axis which is the axis of the internal surface, the rotor having a circular cylindrical external surface, the chamber axis passing through the rotor, a generatrix of the external surface being adjacent to the internal surface, and a diametrically opposite generatrix being spaced from the internal surface;

a vane member mounted on the casing and being pivotable about a pivot axis parallel to the chamber axis, the vane member being accommodated in a fluid inlet/outlet aperture in the casing, the vane member having a passageway communicating between the exterior of the casing and the operating chamber, the vane member having an arcuate end face which is coaxial with said pivot axis and which has a length substantially equal to that of the rotor, the vane member having lateral faces extending from the respective lateral ends of the arcuate face towards said pivot axis, and the vane member having an arcuate tip face adjacent the rotor, said faces being sealing faces with respect to corresponding surfaces of the casing aperture and the rotor; and a linkage which connects the vane member to the rotor so as to keep the tip face of the vane member in sealing contact with the external surface of the rotor, the linkage being connected to the vane member by an articulation having an articulation axis such that a plane containing the articulation axis and the axis of the external surface passes through the region of sealing contact;

wherein the rotor comprises a rotating inner part and a non-rotating outer part;

wherein said non-rotating outer part has a shallow arcuate recess which receives the arcuate tip face of the vane member;

wherein the linkage comprises an appendage connected to said non-rotating outer part at a location between the vane member pivot axis and said arcuate recess and connected to the vane member by said articulation; and wherein said passageway traverses the vane member between the arcuate tip face and the pivot axis of the vane member, and wherein at least two said machines are connected to the inlet manifold;

the casings of the two machines being fixed end-to-end and having a common axis, and the rotor of the two machines being operatively connected to orbit in synchronism.

25. A combined compressor and expander as claimed in claim 24, in which the orbits of the rotor of the two machines are offset in opposite directions with respect to the common axis.

26. An engine system comprising an internal combustion engine having an inlet manifold, and at least one machine connected to the inlet manifold, wherein the at least one machine comprises:

a casing having a circular cylindrical internal surface delimiting an operating chamber;

a rotor in the operating chamber, the rotor being mounted so as to orbit about a chamber axis which is the axis of the internal surface, the rotor having a circular cylindrical external surface, the chamber axis passing through the rotor, a generatrix of the external surface being adjacent to the internal surface, and a diametrically opposite generatrix being spaced from the internal surface;

a vane member mounted on the casing and being pivotable about a pivot axis parallel to the chamber axis, the vane member being accommodated in a fluid inlet/outlet aperture in the casing, the vane member having a passageway communicating between the exterior of the casing and the operating chamber, the vane member having an arcuate end face which is coaxial with said pivot axis and which has a length substantially equal to that of the rotor, the vane member having lateral faces extending from the respective lateral ends of the arcuate face towards said pivot axis, and the vane member having an arcuate tip face adjacent the rotor, said faces being sealing faces with respect to corresponding surfaces of the casing aperture and the rotor; and a linkage which connects the vane member to the rotor so as to keep the tip face of the vane member in sealing contact with the external surface of the rotor, the linkage being connected to the vane member by an articulation having an articulation axis such that a plane containing the articulation axis and the axis of the external surface passes through the region of sealing contact;

wherein the rotor comprises a rotating inner part and a non-rotating outer part;

wherein said non-rotating outer part has a shallow arcuate recess which receives the arcuate tip face of the vane member;

wherein the linkage comprises an appendage connected to said non-rotating outer part at a location between the vane member pivot axis and said arcuate recess and connected to the vane member by said articulation; and wherein said passageway traverses the vane member between the arcuate tip face and the pivot axis of the vane member.

27. An engine system as claimed in claim 26, in which at least two said machines are connected to the inlet manifold.

28. An engine system as claimed in claim 27, in which at least one of the said machines is connected to the inlet manifold by a valve for selectively directing the airflow from the said one machine to the inlet manifold or to the atmosphere.

29. An engine system as claimed in claim 27, in which a pair of the said machines is arranged in such a manner that out of balance forces oppose one another.

30. An engine system as claimed in claim 27, in which at least one said machine is connected to an energy-using device and the rotor of the said machine is drivable by the pressure difference between ambient air and air at the inlet manifold.

31. An engine system comprising an internal combustion engine having an inlet manifold, and at least one machine connected to the inlet manifold, and also comprising an exhaust turbine, with the exhaust turbine constituted by a machine comprising:

a casing having a circular cylindrical internal surface delimiting an operating chamber;

a rotor in the operating chamber, the rotor being mounted so as to orbit about a chamber axis which is the axis of the internal surface, the rotor having a circular cylindrical external surface, the chamber axis passing through the rotor, a generatrix of the external surface being adjacent to the internal surface, and a diametrically opposite generatrix being spaced from the internal surface;

a vane member mounted on the casing and being pivotable about a pivot axis parallel to the chamber axis, the vane member being accommodated in a fluid inlet/outlet aperture in the casing, the vane member having a passageway communicating between the exterior of the casing and the operating chamber, the vane member having an arcuate end face which is coaxial with said pivot axis and which has a length substantially equal to that of the rotor, the vane member having lateral faces extending from the respective lateral ends of the arcuate face towards said pivot axis, and the vane member having an arcuate tip face adjacent the rotor, said faces being sealing faces with respect to corresponding surfaces of the casing aperture and the rotor; and a linkage which connects the vane member to the rotor so as to keep the tip face of the vane member in sealing contact with the external surface of the rotor, the linkage being connected to the vane member by an articulation having an articulation axis such that a plane containing the articulation axis and the axis of the external surface passes through the region of sealing contact;

wherein the rotor comprises a rotating inner part and a non-rotating outer part;

wherein said non-rotating outer part has a shallow arcuate recess which receives the arcuate tip face of the vane member;

wherein the linkage comprises an appendage connected to said non-rotating outer part at a location between the vane member pivot axis and said arcuate recess and connected to the vane member by said articulation; and wherein said passageway traverses the vane member between the arcuate tip face and the pivot axis of the vane member.

32. A heat pump including a compressor and an expander, at least one of the compressor and expander being constituted by a machine comprising:

a casing having a circular cylindrical internal surface delimiting an operating chamber;

a rotor in the operating chamber, the rotor being mounted so as to orbit about a chamber axis which is the axis of the internal surface, the rotor having a circular cylindrical external surface, the chamber axis passing through the rotor, a generatrix of the external surface being adjacent to the internal surface, and a diametrically opposite generatrix being spaced from the internal surface;

a vane member mounted on the casing and being pivotable about a pivot axis parallel to the chamber axis, the vane member being accommodated in a fluid inlet/outlet aperture in the casing, the vane member having a passageway communicating between the exterior of the casing and the operating chamber, the vane member having an arcuate end face which is coaxial with said pivot axis and which has a length substantially equal to that of the rotor, the vane member having lateral faces extending from the respective lateral ends of the arcuate face towards said pivot axis, and the vane member having an arcuate tip face adjacent the rotor, said faces being sealing faces with respect to corresponding surfaces of the casing aperture and the rotor; and a linkage which connects the vane member to the rotor so as to keep the tip face of the vane member in sealing contact with the external surface of the rotor, the linkage being connected to the vane member by an articulation having an articulation axis such that a plane containing the articulation axis and the axis of the external surface passes through the region of sealing contact;

wherein the rotor comprises a rotating inner part and a non-rotating outer part;

wherein said non-rotating outer part has a shallow arcuate recess which receives the arcuate tip face of the vane member;

wherein the linkage comprises an appendage connected to said non-rotating outer part at a location between the vane member pivot axis and said arcuate recess and connected to the vane member by said articulation; and wherein said passageway traverses the vane member between the arcuate tip face and the pivot axis of the vane member.

* * * * *